US010589540B2

(12) United States Patent
Sasaki

(10) Patent No.: US 10,589,540 B2
(45) Date of Patent: Mar. 17, 2020

(54) HEAD PRESSING MECHANISM AND TAPE PRINTING APPARATUS

(71) Applicant: SEIKO EPSON CORPORATION, Tokyo (JP)

(72) Inventor: Taishi Sasaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/950,790

(22) Filed: Apr. 11, 2018

(65) Prior Publication Data

US 2018/0297374 A1 Oct. 18, 2018

(30) Foreign Application Priority Data

Apr. 13, 2017 (JP) ..... 2017-079625
Dec. 27, 2017 (JP) ..... 2017-250961

(51) Int. Cl.
*B41J 25/312* (2006.01)
*B41J 2/32* (2006.01)
*B41J 11/04* (2006.01)
*B41J 15/04* (2006.01)
(Continued)

(52) U.S. Cl.
CPC ..... *B41J 2/32* (2013.01); *B41J 2/325* (2013.01); *B41J 11/0025* (2013.01); *B41J 11/04* (2013.01); *B41J 15/04* (2013.01); *B41J 15/044* (2013.01); *B41J 25/312* (2013.01)

(58) Field of Classification Search
CPC ... B41J 2/32; B41J 2/325; B41J 15/044; B41J 15/04; B41J 11/0025; B41J 11/04; B41J 25/312
See application file for complete search history.

(56) References Cited

U.S. PATENT DOCUMENTS 7,893,952 B2 * 2/2011 Bandholz ..... B41J 2/325 347/197
2003/0184640 A1 10/2003 Sasaki
2006/0007294 A1 1/2006 Sago et al.
(Continued)

FOREIGN PATENT DOCUMENTS

EP 0593269 A2 10/1993
EP 0593269 A2 * 4/1994 ..... B26D 1/305
(Continued)

OTHER PUBLICATIONS

Extended European Search Report dated Aug. 27, 2018 in related European Appl. 18167182.7 (11 pgs.).

*Primary Examiner* — Huan H Tran
(74) *Attorney, Agent, or Firm* — Foley & Lardner LLP

(57) ABSTRACT

In a case where a first tape cartridge is mounted on a cartridge mounting portion, in which the first tape cartridge that accommodates first tape and a first platen roller having a first roller length and a second tape cartridge that accommodates second tape and a second platen roller having a second roller length larger than the first roller length are mounted, a thermal head that performs printing onto the first tape is pressed against the first platen roller at first head pressing force, and in a case where the second tape cartridge is mounted on the cartridge mounting portion, the thermal head that performs printing onto the second tape is pressed against the second platen roller at second head pressing force larger than the first head pressing force.

20 Claims, 17 Drawing Sheets

(51) Int. Cl.
*B41J 11/00* (2006.01)
*B41J 2/325* (2006.01)

(56) References Cited

U.S. PATENT DOCUMENTS

| | | | | |
|---|---|---|---|---|
| 2012/0242772 | A1 | 9/2012 | Jimbo | |
| 2013/0114988 | A1* | 5/2013 | Sodeyama | B41J 3/4075 400/613 |
| 2015/0283836 | A1 | 10/2015 | Sakano et al. | |
| 2016/0096382 | A1 | 4/2016 | Kojima | |

FOREIGN PATENT DOCUMENTS

| | | | | |
|---|---|---|---|---|
| EP | 0696510 | A1 * | 2/1996 | B41J 2/325 |
| EP | 0696590 | A1 | 2/1996 | |
| EP | 3124272 | A1 | 2/2017 | |
| JP | 61-206671 | A | 9/1986 | |
| JP | 2003-291385 | A | 10/2003 | |
| JP | 2006-021497 | A | 1/2006 | |
| JP | 2007-168350 | A | 7/2007 | |
| JP | 2012-200867 | A | 10/2012 | |
| JP | 2012-210800 | A | 11/2012 | |
| JP | 2013-244636 | A | 12/2013 | |
| JP | 2014-210411 | A | 11/2014 | |
| JP | 2017-019140 | A | 1/2017 | |
| WO | WO2012/008126 | A1 | 1/2012 | |

* cited by examiner

HEAD PRESSING MECHANISM AND TAPE PRINTING APPARATUS

BACKGROUND

1. Technical Field

The present invention relates to a head pressing mechanism and a tape printing apparatus, which press a thermal head.

2. Related Art

In the related art, a printing apparatus (thermal printer) including a thermal head and a head pressing mechanism that presses the thermal head against a platen roller (platen) is known as disclosed in JP-A-2017-019140. In this paragraph, words in parentheses are names used in JP-A-2017-019140.

However, when platen rollers are accommodated in tape cartridges instead of being provided in a tape printing apparatus, the lengths of the platen rollers differ in some cases, for example, since the widths of tape differ between the plurality of types of tape cartridges. In a case where the lengths of the platen rollers differ, pressure receiving areas of the platen rollers, which receive the pressing from the thermal head, also differ. For this reason, when head pressing force of pressing the thermal head against the platen rollers is constant, pressures received by the platen rollers from the thermal head vary according to the lengths of the platen rollers. When there are variations in pressures received by the platen rollers from the thermal head, variations in print density occur.

In a head pressing mechanism that moves a pressing pin, which is a pressing center, in a shaft direction of the platen shaft in which the platen rollers are inserted in order to switch between pressing center positions of the thermal head with respect to the platen rollers according to a type of the tape cartridge mounted on the tape printing apparatus, the pressing pin is caught in the middle of moving and thus there is a possibility that the pressing centers cannot be appropriately switched.

The invention can be realized in the following aspects or application examples.

SUMMARY

An advantage of some aspects of the invention is to provide a head pressing mechanism and a tape printing apparatus, which can make variations in pressures received by platen rollers from a thermal head smaller also in a case where the lengths of the platen rollers differ.

In addition, an advantage of some aspects of the invention is to provide a head pressing mechanism and a tape printing apparatus, which can appropriately switch pressing centers of a thermal head with respect to platen rollers.

According to an aspect of the invention, there is provided a head pressing mechanism provided in a tape printing apparatus having a cartridge mounting portion, in which a first tape cartridge that accommodates first tape having a first tape width and a first platen roller having a first roller length and a second tape cartridge that accommodates second tape having a second tape width larger than the first tape width and a second platen roller having a second roller length larger than the first roller length are mounted, and a thermal head that performs printing onto the first tape and the second tape. The thermal head is pressed against the first platen roller at first head pressing force when the first tape cartridge is mounted, and the thermal head is pressed against the second platen roller at second head pressing force larger than the first head pressing force when the second tape cartridge is mounted.

According to this configuration, the head pressing force of pressing the thermal head against the first platen roller or the second platen roller differs. The head pressing force is the first head pressing force when the first tape cartridge accommodating the first platen roller is mounted, and is the second head pressing force larger than the first head pressing force when the second tape cartridge accommodating the second platen roller is mounted. Therefore, also in a case where the lengths of the platen rollers differ, variations in pressures received by the platen rollers from the thermal head can be made smaller.

In this case, it is preferable that an elastic body that applies force to the thermal head such that the thermal head is pressed against the first platen roller or the second platen roller be included, an elastically deformed amount of the elastic body be a first deformed amount when the first tape cartridge is mounted, and the elastically deformed amount of the elastic body be a second deformed amount larger than the first deformed amount when the second tape cartridge is mounted.

According to this configuration, the elastically deformed amounts of the elastic body differ. The elastically deformed amount of the elastic body is the first deformed amount when the first tape cartridge is mounted, and is the second deformed amount larger than the first deformed amount when the second tape cartridge is mounted. Consequently, the head pressing force of pressing the thermal head against the first platen roller or the second platen roller differs. The head pressing force is the first head pressing force when the first tape cartridge is mounted, and is the second head pressing force larger than the first head pressing force when the second tape cartridge is mounted.

In this case, it is preferable that an elastic side member to which one end of the elastic body is attached, and which is positioned at a first elastic position where the elastic body is elastically deformed such that the elastically deformed amount of the elastic body is the first deformed amount when the first tape cartridge is mounted, and is positioned at a second elastic position where the elastic body is elastically deformed such that the elastically deformed amount of the elastic body is the second deformed amount when the second tape cartridge is mounted be further included.

According to this configuration, the positions of the elastic side member differ. The position of the elastic side member is the first elastic position when the first tape cartridge is mounted, and is the second elastic position when the second tape cartridge is mounted. Consequently, it is possible to make the elastically deformed amounts of the elastic body differ. The elastically deformed amount of the elastic body is the first deformed amount when the first tape cartridge is mounted, and is the second deformed amount larger than the first deformed amount when the second tape cartridge is mounted.

In this case, it is preferable that a cover side member that is provided in a cover opening/closing the cartridge mounting portion, engages with the elastic side member so as to be positioned at a first engagement position where the elastic side member is positioned at the first elastic position if the cover is closed when the first tape cartridge is mounted, and engages with the elastic side member so as to be positioned at a second engagement position where the elastic side member is positioned at the second elastic position if the cover is closed when the second tape cartridge is mounted be further included.

According to this configuration, the positions of the cover side member in a state where the cover is closed differ. The position of the cover side member is the first engagement position when the first tape cartridge is mounted, and is the second engagement position when the second tape cartridge is mounted. Consequently, it is possible to make the positions of the elastic side member in a state where the cover is closed differ. The position of the elastic side member is the first elastic position when the first tape cartridge is mounted, and is the second elastic position when the second tape cartridge is mounted.

In this case, it is preferable that the cover side member be positioned at the first engagement position by not engaging with the first tape cartridge if the cover is closed when the first tape cartridge is mounted and the cover side member be positioned at the second engagement position by engaging with the second tape cartridge if the cover is closed when the second tape cartridge is mounted.

According to this configuration, the positions of the cover side member in a state where the cover is closed differ. The position of the cover side member is the first engagement position when the first tape cartridge is mounted, and is the second engagement position when the second tape cartridge is mounted. Whether or not the cover side member engages with the first tape cartridge or second tape cartridge when the cover is closed differs between when the first tape cartridge is mounted and when the second tape cartridge is mounted. Consequently, it is possible to make the positions of the cover side member in a state where the cover is closed differ. The position of the cover side member is the first engagement position when the first tape cartridge is mounted, and is the second engagement position when the second tape cartridge is mounted.

In this case, it is preferable that the cover side member be provided so as to be rotatable at the first engagement position and the second engagement position, the elastic side member be provided so as to be rotatable at the first elastic position and the second elastic position, the elastic side member rotate from the first elastic position to the second elastic position while shifting an engaging part with the cover side member from a first engaging part to a second engaging part when the cover side member rotates from the first engagement position to the second engagement position, and the elastic side member rotate by a first rotation amount with respect to a unit rotation amount of the cover side member when engaging with the cover side member in a first engaging region including the first engaging part, and rotate by a second rotation amount smaller than the first rotation amount with respect to the unit rotation amount of the cover side member when engaging with the cover side member in a second engaging region including the second engaging part.

According to this configuration, when the cover side member is rotated only to a position immediately in front of the second engagement position, that is, also when the cover side member is rotated only to a position where the cover side member engages with the elastic side member immediately in front of the second engaging part in the second engaging region due to an effect of friction after the cover side member engages with the second tape cartridge, the elastic side member is positioned at the second elastic position, or in the vicinity of the second elastic position. As a result, a difference between the second deformed amount when the cover side member is rotated only to a position immediately in front of the second engagement position and the second deformed amount when the cover side member is rotated to the second engagement position is smaller. Therefore, a difference between the second head pressing force when the cover side member is rotated only to a position immediately in front of the second engagement position and the second head pressing force when the cover side member is rotated to the second engagement position can be made smaller.

In this case, it is preferable that the second tape cartridge have a second cartridge case that accommodates the second platen roller, the second cartridge case have a first wall portion facing the cover when the cover is closed in a state where the second tape cartridge is mounted on the cartridge mounting portion and a second wall portion provided on a peripheral portion of the first wall portion, and the cover side member engage with the second tape cartridge including the peripheral portion of the first wall portion.

According to this configuration, when the cover is closed, pressing against the second tape cartridge from the cover side member is received by the second wall portion. For this reason, the deflection of the first wall portion caused by the pressing from the cover side member can be suppressed.

In this case, it is preferable that a first elastic body that elastically deforms when the first tape cartridge is mounted and applies force to the thermal head such that the thermal head is pressed against the first platen roller at the first head pressing force and a second elastic body that elastically deforms when the second tape cartridge is mounted and applies force to the thermal head such that the thermal head is pressed against the second platen roller at the second head pressing force be included.

According to this configuration, the first elastic body elastically deforms when the first tape cartridge is mounted, and the second elastic body elastically deforms when the second tape cartridge is mounted. Consequently, the head pressing force of pressing the thermal head against the first platen roller or the second platen roller differs. The head pressing force is the first head pressing force when the first tape cartridge is mounted, and is the second head pressing force larger than the first head pressing force when the second tape cartridge is mounted.

In this case, it is preferable that a first elastic side member to which one end of the first elastic body is attached and which elastically deforms the first elastic body when the first tape cartridge is mounted and a second elastic side member to which one end of the second elastic body is attached and which elastically deforms the second elastic body when the second tape cartridge is mounted be further included.

According to this configuration, which one of the first elastic side member and the second elastic side member operates differs between when the first tape cartridge is mounted and when the second tape cartridge is mounted. Consequently, the first elastic body can be elastically deformed when the first tape cartridge is mounted, and the second elastic body can be elastically deformed when the second tape cartridge is mounted.

In this case, it is preferable that a cover side member that is provided in a cover opening/closing the cartridge mounting portion, is positioned at a first engagement position where the cover side member engages with the first elastic side member if the cover is closed when the first tape cartridge is mounted, and is positioned at a second engagement position where the cover side member engages with the second elastic side member if the cover is closed when the second tape cartridge is mounted be further included.

According to this configuration, the positions of the cover side member in a state where the cover is closed differ. The position of the cover side member is the first engagement position when the first tape cartridge is mounted, and is the second engagement position when the second tape cartridge is mounted. Consequently, it is possible to make which one of the first elastic side member and the second elastic side member operates differ between when the first tape cartridge is mounted and when the second tape cartridge is mounted.

In this case, it is preferable that the cover side member have a first engagement portion in a shape complementary to a second engagement portion provided in the second tape cartridge and the first engagement portion engage with the second engagement portion if the cover is closed when the second tape cartridge is mounted.

According to this configuration, the cover side member can effectively push the second tape cartridge to the inside of the mounting direction in a state where the first engagement portion engages with the second engagement portion.

According to another aspect of the invention, there is provided a tape printing apparatus including a cartridge mounting portion in which a first tape cartridge that accommodates first tape having a first tape width and a first platen roller having a first roller length and a second tape cartridge that accommodates second tape having a second tape width larger than the first tape width and a second platen roller having a second roller length larger than the first roller length are mounted, a thermal head that performs printing onto the first tape when the first tape cartridge is mounted on the cartridge mounting portion and performs printing onto the second tape when the second tape cartridge is mounted on the cartridge mounting portion, and a head pressing mechanism that presses the thermal head against the first platen roller at first head pressing force when the first tape cartridge is mounted on the cartridge mounting portion, and presses the thermal head against the second platen roller at second head pressing force larger than the first head pressing force when the second tape cartridge is mounted on the cartridge mounting portion.

According to this configuration, the head pressing force of pressing the thermal head against the first platen roller or the second platen roller differs. The head pressing force is the first head pressing force when the first tape cartridge accommodating the first platen roller is mounted, and is the second head pressing force larger than the first head pressing force when the second tape cartridge accommodating the second platen roller is mounted. Consequently, also in a case where the lengths of the platen rollers differ, variations in pressures received by the platen rollers from the thermal head can be made smaller and printing can be performed with variations in print density being suppressed.

According to still another aspect of the invention, there is provided another head pressing mechanism provided in a tape printing apparatus having a cartridge mounting portion, in which a first tape cartridge that accommodates first tape and a first platen roller and a second tape cartridge that accommodates second tape and a second platen roller are mounted, a thermal head that performs printing onto the first tape and the second tape, and a platen shaft into which the first platen roller and the second platen roller are inserted. The mechanism includes a first head mechanism that has a pressing portion and presses the thermal head against the first platen roller by means of the pressing portion when the first tape cartridge is mounted on the cartridge mounting portion and a second head mechanism that is connected to the thermal head, has a connection portion provided at a position different from a position of the pressing portion in a shaft direction of the platen shaft, and presses the thermal head against the second platen roller by means of the connection portion when the second tape cartridge is mounted on the cartridge mounting portion.

According to this configuration, when the first tape cartridge is mounted, the thermal head is pressed against the first platen roller with the pressing portion as the pressing center. When the second tape cartridge is mounted, the thermal head is pressed against the second platen roller with the connection portion provided at a position different from the position of the pressing portion in the shaft direction of the platen shaft as the pressing center. Therefore, the pressing center of the thermal head with respect to the platen roller can be appropriately changed.

In this case, it is preferable that the first head mechanism have a first head frame on which the pressing portion is provided, and press the thermal head against the first platen roller by means of the pressing portion by the first head frame operating when the first tape cartridge is mounted on the cartridge mounting portion, and the second head mechanism have a second head frame on which the connection portion is provided, and press the thermal head against the second platen roller by means of the connection portion by the second head frame operating when the second tape cartridge is mounted on the cartridge mounting portion.

According to this configuration, when the first tape cartridge is mounted, the thermal head is pressed against the first platen roller with the pressing portion as the pressing center by the first head frame operating. When the second tape cartridge is mounted, the thermal head is pressed against the second platen roller with the connection portion as the pressing center by the second head frame operating.

In this case, it is preferable that in the shaft direction of the platen shaft, a distance between the pressing portion and a first center portion, which is a center portion of the first platen roller in the first tape cartridge mounted on the cartridge mounting portion, be shorter than a distance between the pressing portion and a second center portion, which is a center portion of the second platen roller in the second tape cartridge mounted on the cartridge mounting portion, and in the shaft direction of the platen shaft, a distance between the connection portion and the second center portion be shorter than a distance between the connection portion and the first center portion.

According to this configuration, when the first tape cartridge is mounted, the thermal head is pressed against the first platen roller by the pressing portion with an area close to the first center portion as the pressing center. Consequently, concentration of pressing force applied to the thermal head against the first platen roller in the shaft direction of the platen shaft is suppressed. When the second tape cartridge is mounted, the thermal head is pressed against the second platen roller by the connection portion with an area close to the second center portion as the pressing center. Consequently, concentration of pressing force applied to the thermal head against the second platen roller in the shaft direction of the platen shaft is suppressed.

In this case, it is preferable that a head contact portion that is positioned closer to an inside of a mounting direction of the first tape cartridge and the second tape cartridge than the connection portion is positioned, and causes the thermal head to take an inclined posture, in which an end portion on the inside of the mounting direction approaches the platen shaft and an end portion on an immediately front side of the mounting direction is separated away from the platen shaft, by coming into contact with the thermal head when the cover opening/closing the cartridge mounting portion is opened be further included.

According to this configuration, an interval between the end portion of the thermal head on the immediately front side of the mounting direction and the platen shaft is wider compared to a case where the thermal head takes a posture in which the thermal head is in parallel with the platen shaft. Therefore, when mounting/detaching the first tape cartridge onto/from the cartridge mounting portion, the first tape getting caught in the end portion of the thermal head on the immediately front side of the mounting direction is suppressed. Similarly, when mounting/detaching the second tape cartridge onto/from the cartridge mounting portion, the second tape getting caught in the end portion of the thermal head on the immediately front side of the mounting direction is suppressed.

In this case, it is preferable that the pressing portion function as the head contact portion.

According to this configuration, since the pressing portion provided on the second head mechanism functions as the head contact portion, the assemblability of the head pressing mechanism can be improved compared to when a member (for example, a projection provided on the exterior) different from the pressing portion functions as the head contact portion.

According to still another aspect of the invention, there is provided another tape printing apparatus including a cartridge mounting portion in which a first tape cartridge that accommodates first tape and a first platen roller and a second tape cartridge that accommodates second tape and a second platen roller are mounted, a thermal head that performs printing onto the first tape and the second tape, a platen shaft into which the first platen roller and the second platen roller are inserted, and a head pressing mechanism including a first head mechanism that has a pressing portion and presses the thermal head against the first platen roller by means of the pressing portion when the first tape cartridge is mounted on the cartridge mounting portion, and a second head mechanism that is connected to the thermal head, has a connection portion provided at a position different from a position of the pressing portion in a shaft direction of the platen shaft, and presses the thermal head against the second platen roller by means of the connection portion when the second tape cartridge is mounted on the cartridge mounting portion.

According to this configuration, when the first tape cartridge is mounted, the thermal head is pressed against the first platen roller by the pressing portion. When the second tape cartridge is mounted, the thermal head is pressed against the second platen roller by the connection portion provided at a position different from the position of the pressing portion in the shaft direction of the platen shaft. Therefore, the pressing center of the thermal head with respect to the platen roller can be appropriately changed. The thermal head is appropriately pressed against the first platen roller or the second platen roller and printing can be performed well.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a tape printing apparatus, which is an embodiment of a head pressing mechanism and a tape printing apparatus of the invention will be described. In order to clarify a disposition relationship of each unit, disposition is expressed in the XYZ-rectangular coordinate system in the following drawings but the use of the XYZ-rectangular coordinate system does not limit the invention at all.

Figure 1:
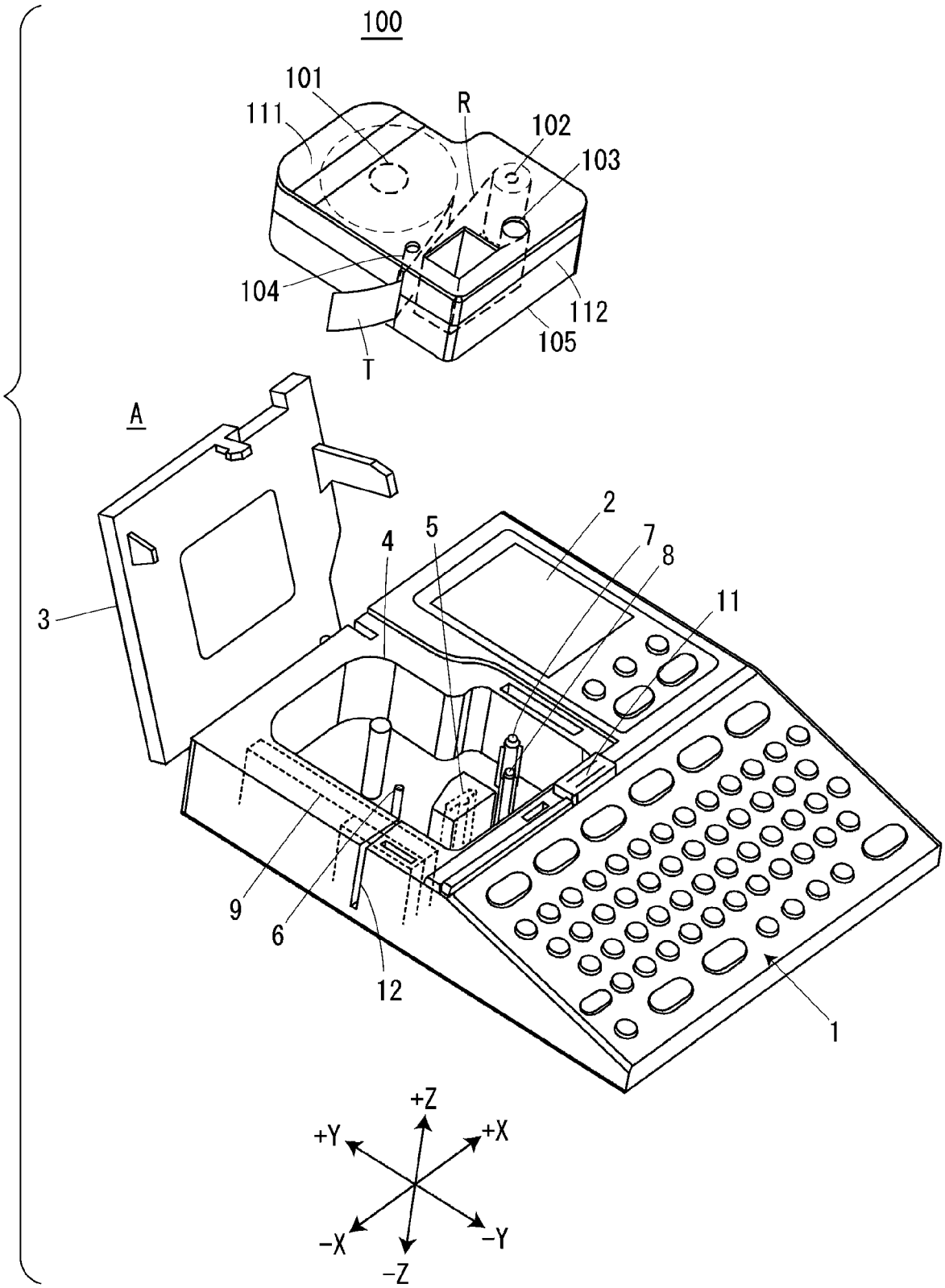
FIG. 1 is a perspective view of a tape printing apparatus according to an embodiment of the invention.

A schematic configuration of a tape printing apparatus A will be described based on FIG. 1. The tape printing apparatus A includes an operation panel 1, a display 2, a cover 3, a cartridge mounting portion 4, a thermal head 5, a platen shaft 6, a reeling-out shaft 7, a winding shaft 8, and a cutter 9.

Various types of buttons, such as letter buttons and a print button, are provided on the operation panel 1, and the operation panel receives various types of operations such as a letter input operation and an instruction operation for printing execution. The display 2 displays letters input from the operation panel 1.

The cover 3 is provided so as to be rotatable about an end portion on a +Y side, and is opened/closed when a user mounts/detaches a tape cartridge 100 onto/from the cartridge mounting portion 4. The cover 3 is locked in a closed state by a cover lock mechanism (not illustrated). Then, when a cover button 11 is pushed, the cover lock mechanism comes into an unlocked state and the cover 3 is opened.

The tape cartridge 100 is detachably mounted from a +Z side onto the cartridge mounting portion 4. Hereinafter, a direction in which the tape cartridge 100 is mounted will be simply referred to as "mounting direction". The tape cartridge 100 includes a tape core 101, a ribbon reeling-out core 102, a ribbon winding core 103, a platen roller 104, and a cartridge case 105 which accommodates all the units of the tape cartridge. Tape T is wound in a roll shape around the tape core 101. Ink ribbon R is wound in a roll shape around the ribbon reeling-out core 102.

Figure 2:
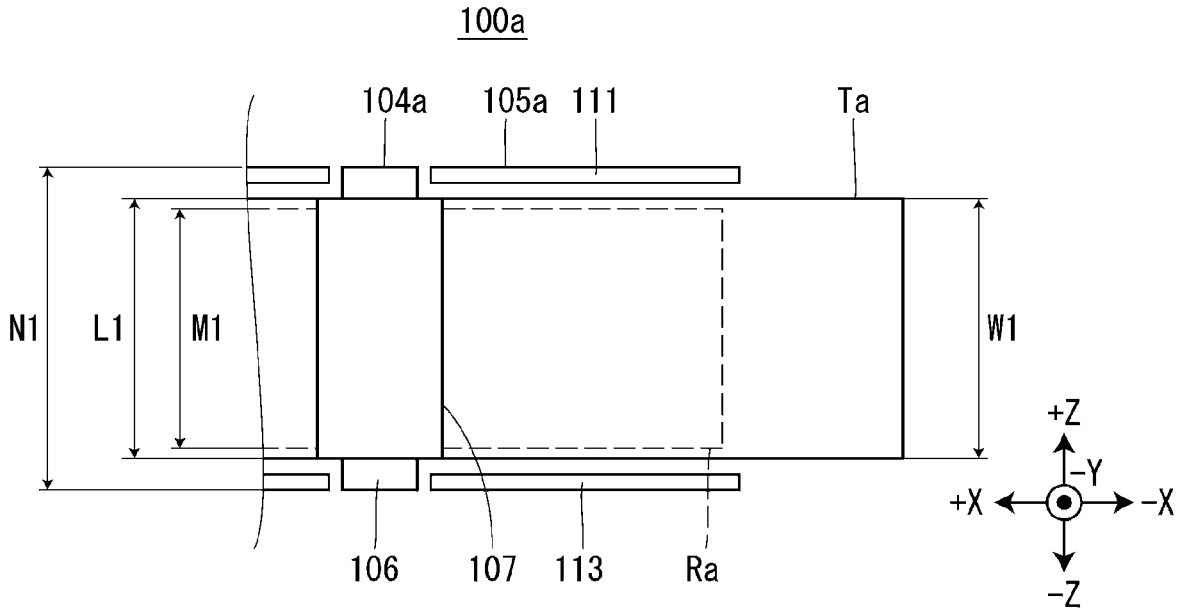
FIG. 2 is a view schematically illustrating a first tape cartridge.

The cartridge case 105 includes a first wall portion 111, a second wall portion 112, and a third wall portion 113 (refer to FIG. 2). The first wall portion 111 is a wall portion that faces the cover 3 in a case where the cover 3 is closed in a state where the tape cartridge 100 is mounted on the cartridge mounting portion 4. That is, in a posture in which the first wall portion 111 faces the +Z side, the tape cartridge 100 is mounted on the cartridge mounting portion 4. The second wall portion 112 is provided on peripheral portions of the first wall portion 111 and the third wall portion 113. That is, the second wall portion 112 configures a peripheral wall portion of the cartridge case 105. The third wall portion 113 opposes the first wall portion 111.

The thermal head 5, the platen shaft 6, the reeling-out shaft 7, and the winding shaft 8 each are provided in the cartridge mounting portion 4 so as to protrude from a bottom surface of the cartridge mounting portion 4 toward the +Z side.

The thermal head 5 is provided on a −Y side of the platen shaft 6. The tape T and the ink ribbon R are pinched between the thermal head 5 and the platen roller 104 when the tape cartridge 100 is mounted on the cartridge mounting portion 4 and then the cover 3 closed. In this state, ink of the ink ribbon R is transferred onto the tape T by the thermal head 5 generating heat. The thermal head 5 is pressed against the platen roller 104 by a head pressing mechanism 20 (refer to FIG. 4) to be described later.

When the tape cartridge 100 is mounted on the cartridge mounting portion 4, the platen roller 104, the ribbon reeling-out core 102, and the ribbon winding core 103 are inserted into the platen shaft 6, the reeling-out shaft 7, and the winding shaft 8, respectively. When a feeding motor 13 (refer to FIG. 12) is rotated in a state the cover 3 is closed, the platen roller 104 rotates and the tape T and the ink ribbon R pinched between the platen roller 104 and the thermal head 5 are fed.

The tape printing apparatus A can switch between normal feeding and reverse feeding of the tape T and the ink ribbon R by controlling a rotation direction of the feeding motor 13. That is, when the feeding motor 13 rotates in a normal direction, the platen roller 104 rotates in the normal direction and the ribbon winding core 103 rotates in a winding direction. Consequently, normal feeding of the tape T and the ink ribbon R is performed. That is, the tape T is reeled out from the tape core 101 and is fed to a tape outlet 12, and the ink ribbon R is reeled out from the ribbon reeling-out core 102 and is wound around the ribbon winding core 103. When the feeding motor 13 rotates in a reverse direction, the platen roller 104 rotates in the reverse direction and the ribbon reeling-out core 102 rotates in a rewinding direction. Consequently, reverse feeding of the tape T and the ink ribbon R is performed. That is, the tape T sent out from the tape outlet 12 is pulled back and the ink ribbon R is rewound around the ribbon reeling-out core 102.

The cutter 9 is provided between the cartridge mounting portion 4 and the tape outlet 12. The cutter 9 performs cutting operation by means of a cutter motor (not illustrated), and cuts, in a width direction of the tape T, the tape T fed from the tape cartridge 100 mounted on the cartridge mounting portion 4 to the tape outlet 12. Consequently, a portion of the tape T on which printing is completed is cut out and is sent out from the tape outlet 12.

In the tape printing apparatus A having such as configuration, normal feeding of the tape T and the ink ribbon R is performed and the thermal head 5 generates heat when a user inputs a desired letter from the operation panel 1 and performs an instruction operation for printing execution. Consequently, the input letter is printed onto the tape T. After printing is terminated, the cutter 9 performs cutting operation and a portion of the tape T on which printing is completed is cut out. After then, reverse feeding of the tape T and the ink ribbon R is performed. Consequently, the tape T is pulled back until a tip of the tape T comes in the vicinity of a pinched position between the thermal head 5 and the platen roller 104, that is, in the vicinity of a print position. For this reason, a margin generated in the front of the tape T to be printed next in a length direction of the tape T, which is attributable to a clearance between the thermal head 5 and the cutter 9, can be made shorter.

Figure 3:
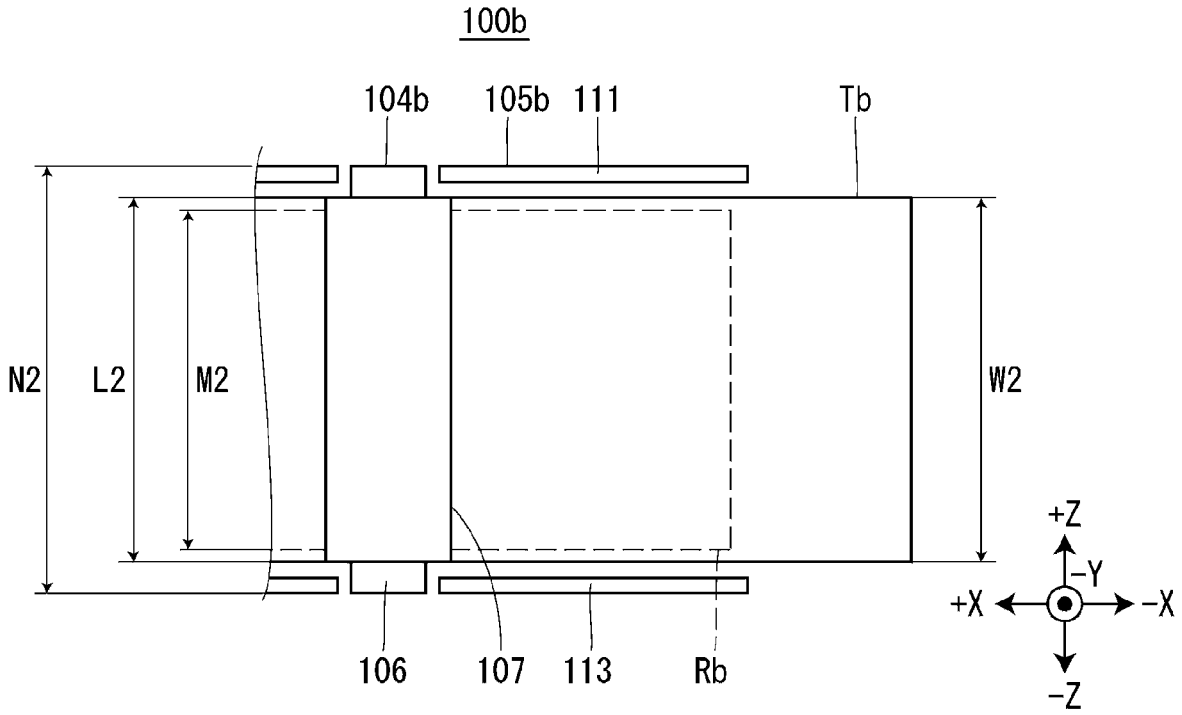
FIG. 3 is a view schematically illustrating a second tape cartridge.

Types of the tape cartridge 100 will be described based on FIGS. 2 and 3. A first tape cartridge 100*a* (refer to FIG. 2) and a second tape cartridge 100*b* (refer to FIG. 3), each of which has the tape T having a different width, are prepared as the tape cartridge 100. First tape Ta having a first tape width W1 (for example, 36 mm) is accommodated in the first tape cartridge 100*a*, and second tape Tb having a second tape width W2 (for example, 50 mm) that is larger than the first tape width W1 is accommodated in the second tape cartridge 100*b*.

In the first tape cartridge 100*a* and the second tape cartridge 100*b*, the length of the platen roller 104, the width of the ink ribbon R, and the thickness of the cartridge case 105 differ according to the width of the tape T. That is, in the first tape cartridge 100*a*, a first platen roller 104*a* having a first roller length L1 and first ink ribbon Ra having a first ribbon width M1 are accommodated in a first cartridge case 105*a* having a first case thickness N1. In the second tape cartridge 100*b*, a second platen roller 104*b* having a second roller length L2 larger than the first roller length L1 and second ink ribbon Rb having a second ribbon width M2 larger than the first ribbon width M1 are accommodated in a second cartridge case 105*b* having a second case thickness N2 larger than the first case thickness N1.

The platen roller 104 includes a roller shaft 106 and a roller body 107. Both end portions of the roller shaft 106 are rotatably supported by the first wall portion 111 and the third wall portion 113 of the cartridge case 105. The roller shaft 106 is inserted in the cylindrical roller body 107. The roller body 107 is a portion that comes into contact with the thermal head 5 via the tape T and the ink ribbon R and receives pressing from the thermal head 5. Herein, the length of the platen roller 104 means the dimension of the roller body 107 in a shaft direction (Z-direction) of the platen roller 104. In addition, the thickness of the cartridge case 105 means the dimension of the cartridge case 105 in the shaft direction (Z-direction) of the platen roller 104.

Figure 4:
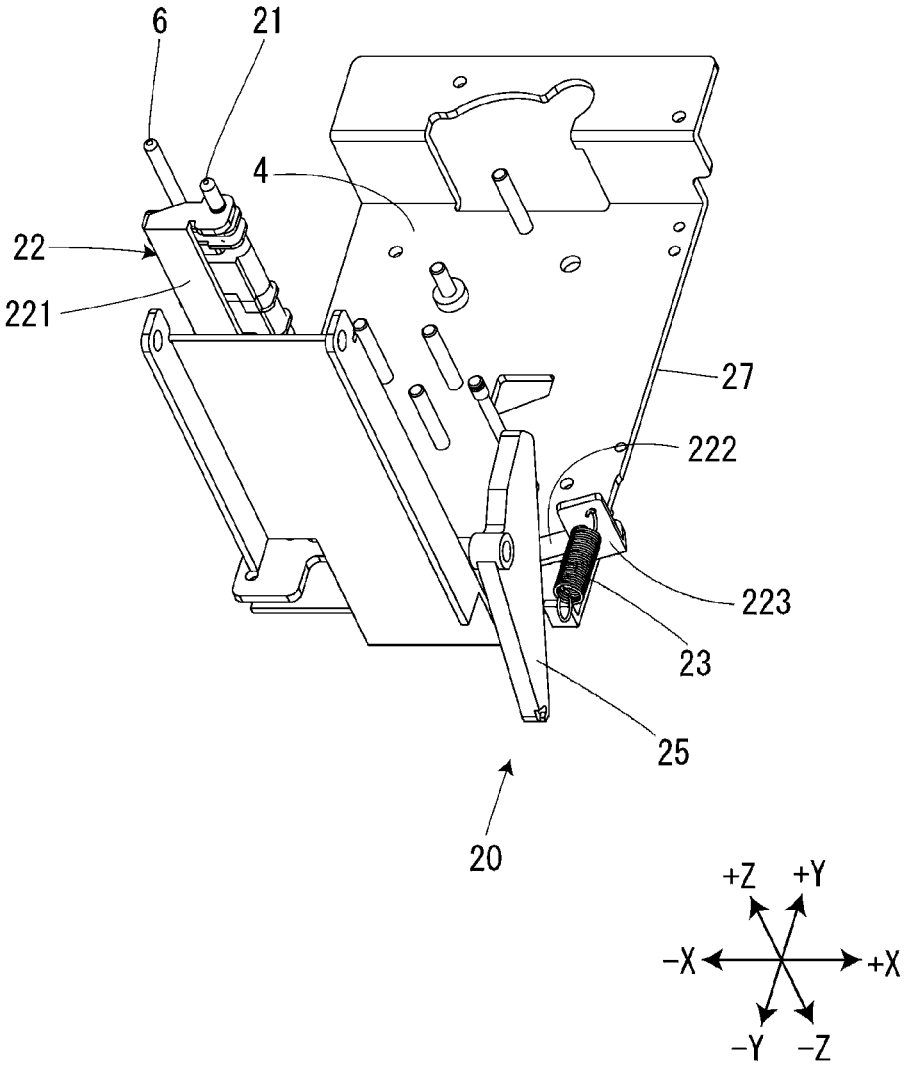
FIG. 4 is a perspective view of a head pressing mechanism.
Figure 5:
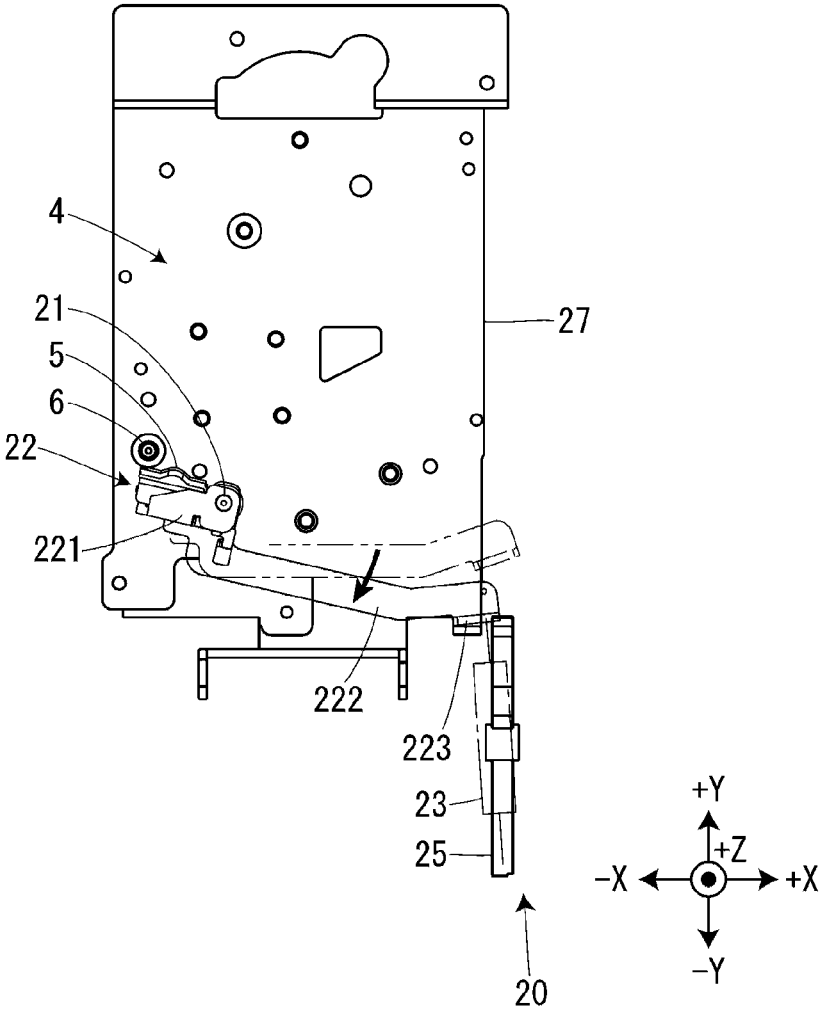
FIG. 5 is a view of the head pressing mechanism seen from a +Z side in a state where a head holder has rotated in a head pressing direction.
Figure 6:
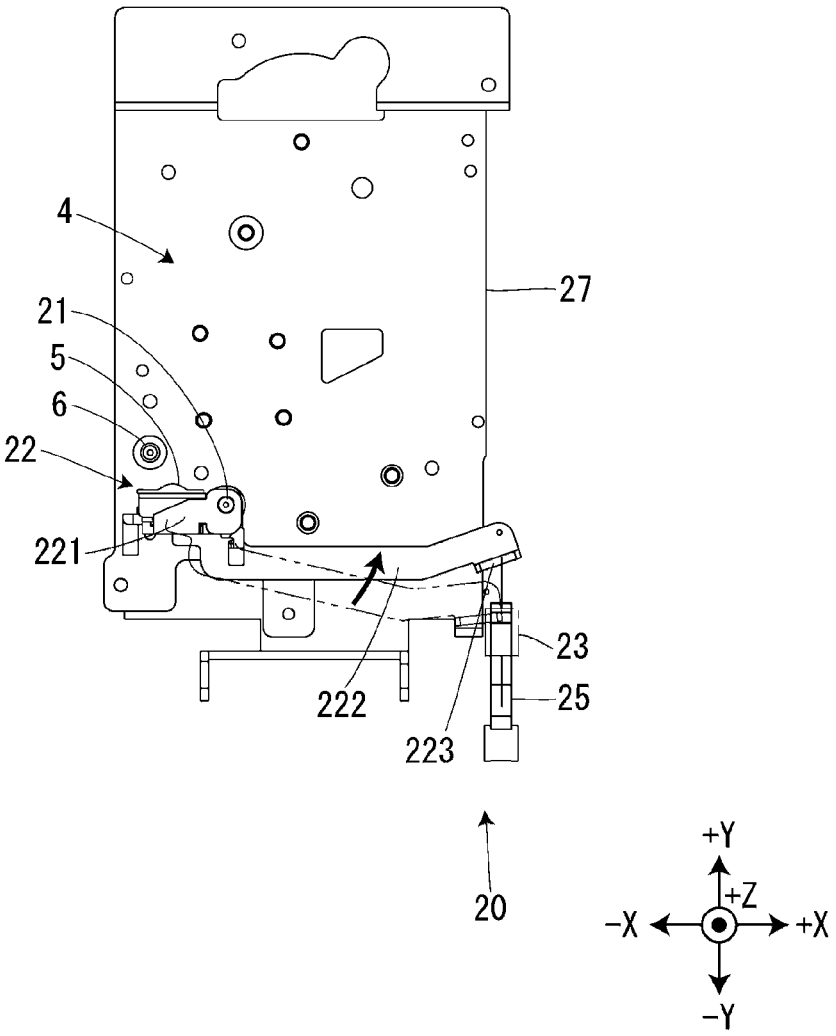
FIG. 6 is a view of the head pressing mechanism seen from the +Z side in a state where the head holder has rotated in a head releasing direction.
Figure 7:
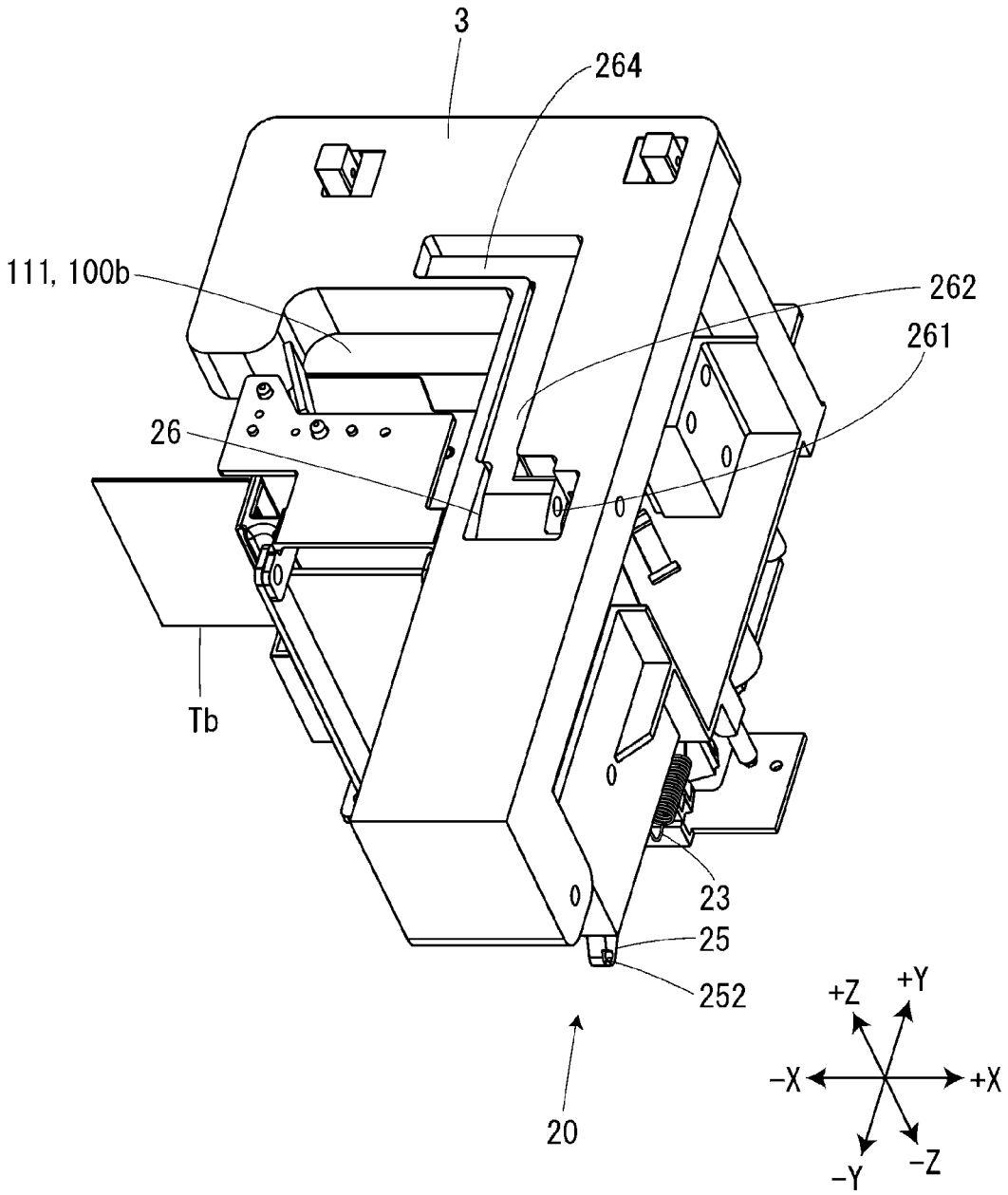
FIG. 7 is a perspective view of the head pressing mechanism and a cover in a state where the second tape cartridge is mounted.

The head pressing mechanism 20 will be described based on FIGS. 4 to 6. The head pressing mechanism 20 presses the thermal head 5 against the platen roller 104 accommodated in the tape cartridge 100 mounted on the cartridge mounting portion 4.

Figure 12:
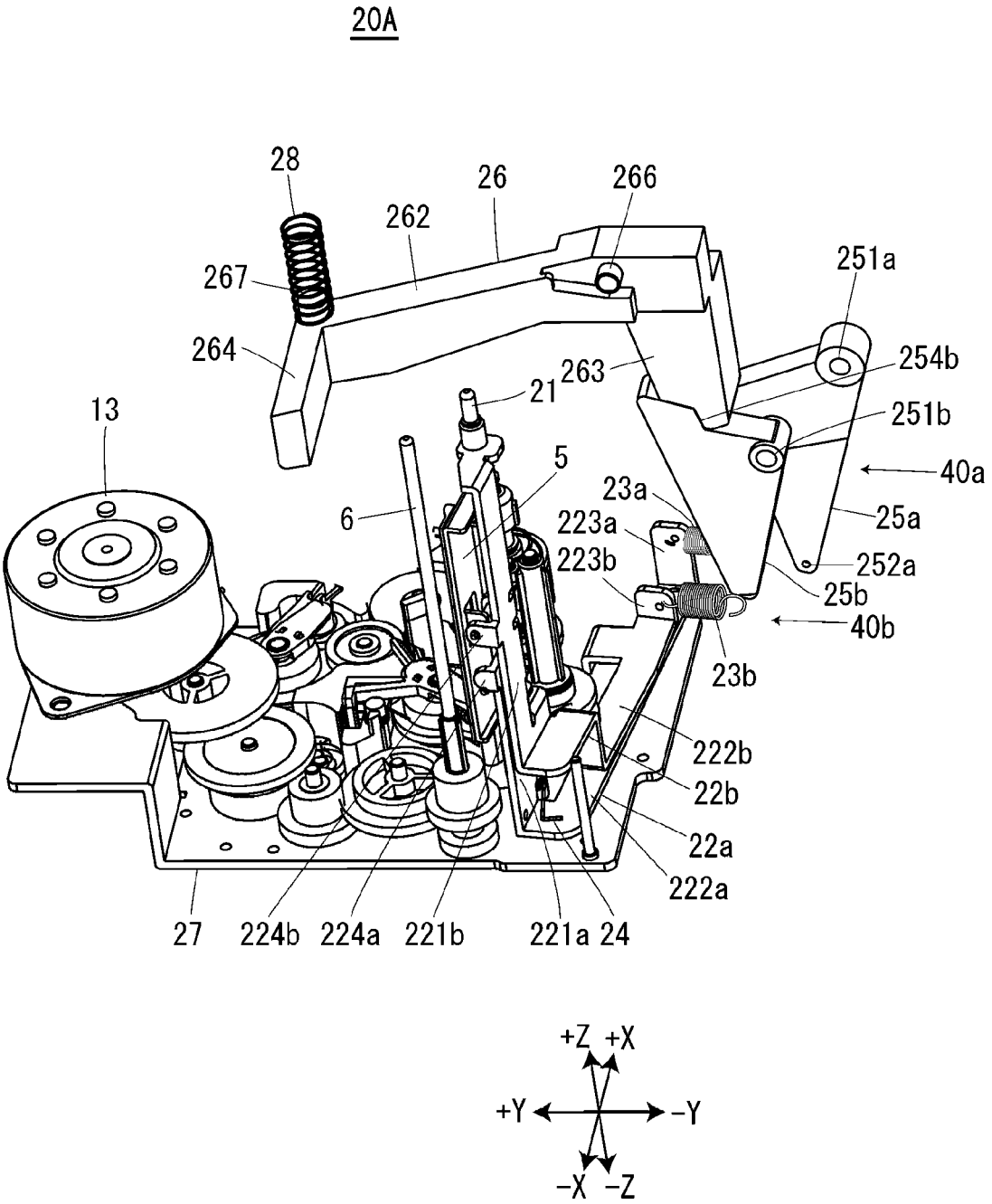
FIG. 12 is a perspective view illustrating a head pressing mechanism of a modification example.
Figure 13:
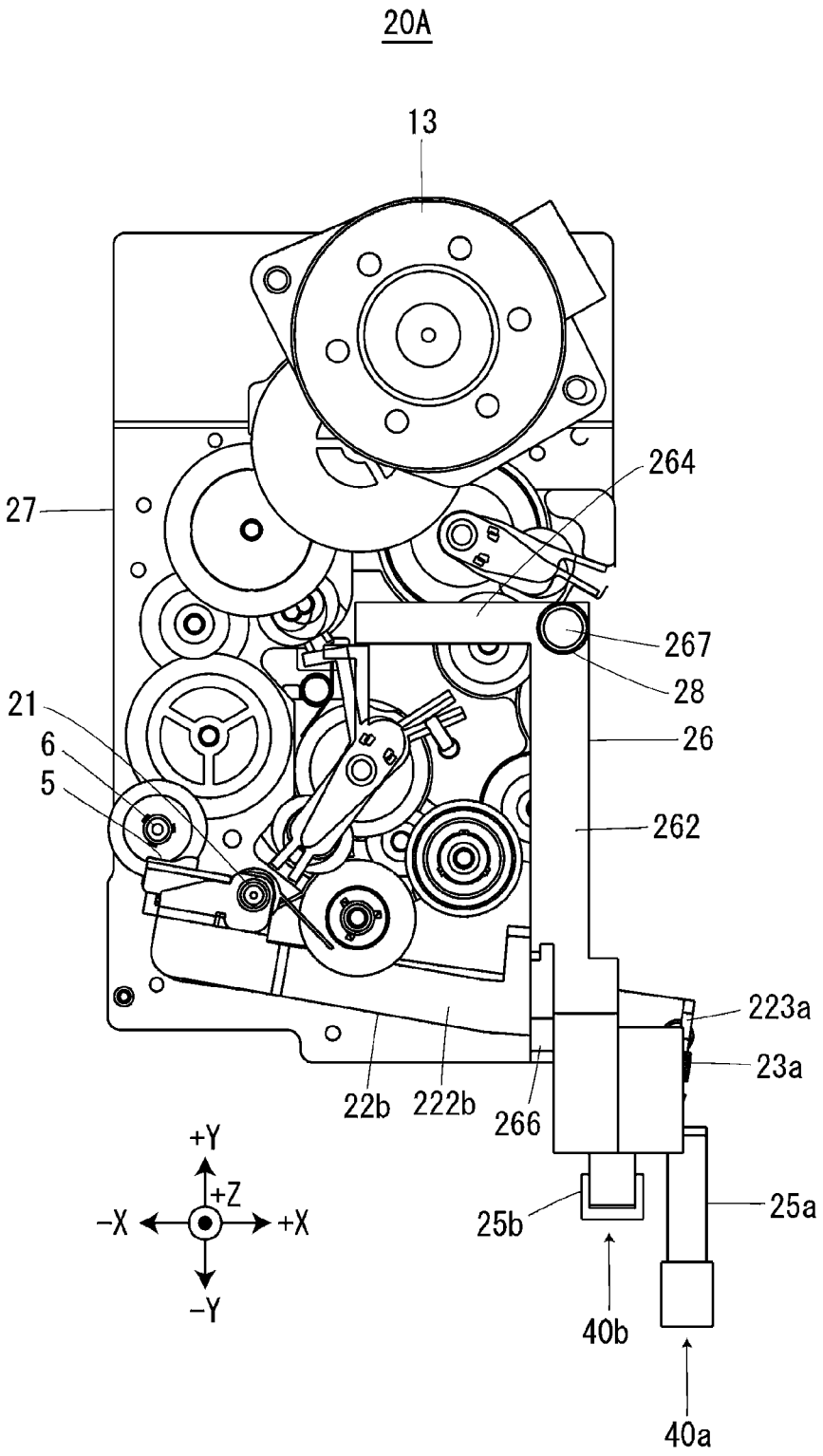
FIG. 13 is a view of the head pressing mechanism of the modification example seen from the +Z side.
Figure 14:
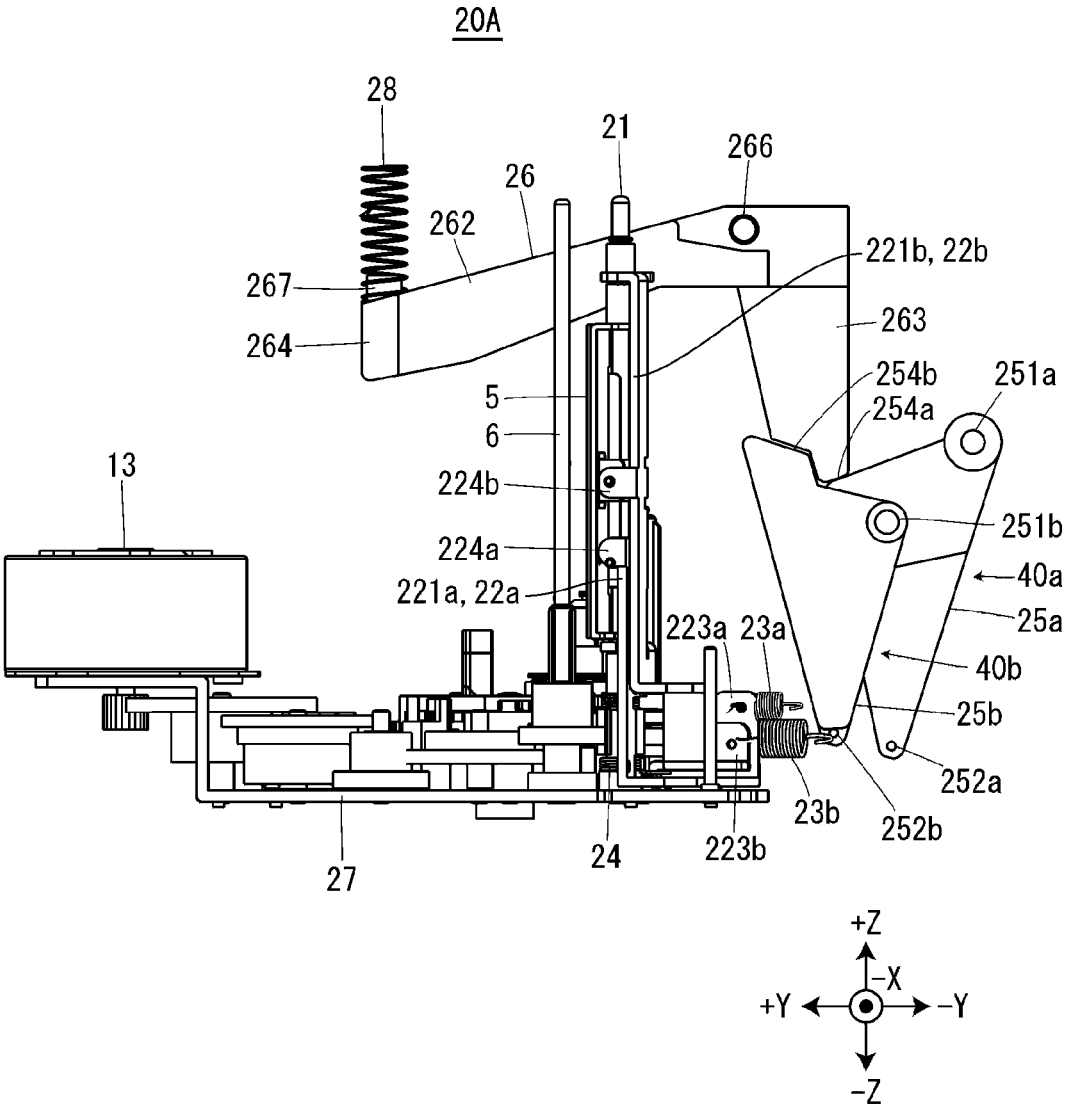
FIG. 14 is a view of the head pressing mechanism of the modification example seen from a −X side.

The head pressing mechanism 20 includes a head supporting shaft 21, a head holder 22, a head pressing spring 23, and a head releasing spring 24 (refer to FIG. 12).

The head supporting shaft 21 is fixed to a base frame 27, and protrudes from the base frame 27 toward the +Z side. The head supporting shaft 21 rotatably supports the head holder 22.

The head holder 22 includes a holder portion 221 and an arm portion 222. The thermal head 5 is held by a surface of the holder portion 221 on the +Y side. The arm portion 222 extends from an end portion of the holder portion 221 on a −Z side toward a +X side. An end portion of the head pressing spring 23 on the +Y side is hooked to an arm tip portion 223 which is an end portion of the arm portion 222 on the +X side.

The head pressing spring 23 is an elastic body for pressing the thermal head 5 against the platen roller 104. The head pressing spring 23 is provided from the arm tip portion 223 toward the −Y side. An end portion of the head pressing spring 23 on the −Y side is hooked to a head pressing lever 25 to be described later. When the head pressing lever 25 pulls the head pressing spring 23 and the head pressing spring stretches, force is applied to the arm tip portion 223 toward the −Y side and force is applied to the head holder 22 in a head pressing direction, that is, a clockwise direction (refer to FIG. 5). For example, a tension coil spring can be used as the head pressing spring 23.

The head releasing spring 24 is an elastic body for separating the thermal head 5 away from the platen roller 104. The head releasing spring 24 is a torsion coil spring wound around the head supporting shaft 21, and applies force to the head holder 22 in a head releasing direction opposite to the head pressing direction of the head pressing spring 23, that is, a counterclockwise direction (refer to FIG. 6). In addition to a torsion coil spring, for example, a tension coil spring provided on a side opposite (+Y side) to the head pressing spring 23 from the arm tip portion 223 may be used as the head releasing spring 24.

The head pressing mechanism 20 having such a configuration can switch between a state where the thermal head 5 is pressed against the platen roller 104 and a state where the thermal head 5 is separated away from the platen roller 104 in tandem with the opening/closing of the cover 3.

That is, although details will be described later, when the cover 3 is closed, the head pressing lever 25 pulls the head pressing spring 23 and the head pressing spring stretches. Accordingly, the elasticity of the head pressing spring 23 exceeds the elasticity of the head releasing spring 24 and the head holder 22 rotates in the head pressing direction (refer to FIG. 5). Consequently, the thermal head 5 is pressed against the platen roller 104, and comes into a state where the tape T and the ink ribbon R are pinched between the platen roller 104 and the thermal head 5, that is, a printable state.

On the other hand, although details will be described later, when the cover 3 is opened, the head pressing spring 23 contracts. Accordingly, the elasticity of the head releasing spring 24 exceeds the elasticity of the head pressing spring 23 and the head holder 22 rotates in the head releasing direction (refer to FIG. 6). Consequently, the thermal head 5 comes into a state of being separated away from the platen roller 104 (or the platen shaft 6), and a user can easily perform a mounting/detaching operation of the tape cartridge 100 onto/from the cartridge mounting portion 4.

The head pressing mechanism 20 will be described in further detail based on FIGS. 7 to 11. In addition to the head supporting shaft 21, the head holder 22, the head pressing spring 23, and the head releasing spring 24, the head pressing mechanism 20 includes the head pressing lever 25 and a head pressing rib 26.

The head pressing lever 25 is rotatably supported by a lever supporting shaft (not illustrated) extending in an X-direction. When the head pressing lever 25 rotates in the clockwise direction in a state where the head pressing spring 23 has contracted (refer to FIG. 11), the head pressing spring 23 stretches. On the other hand, when the head pressing lever 25 rotates in the counterclockwise direction, the head pressing spring 23 contracts.

The head pressing lever 25 includes a lever shaft hole 251, a pressing spring hooking hole 252, and an engaging region 253.

Figure 11:
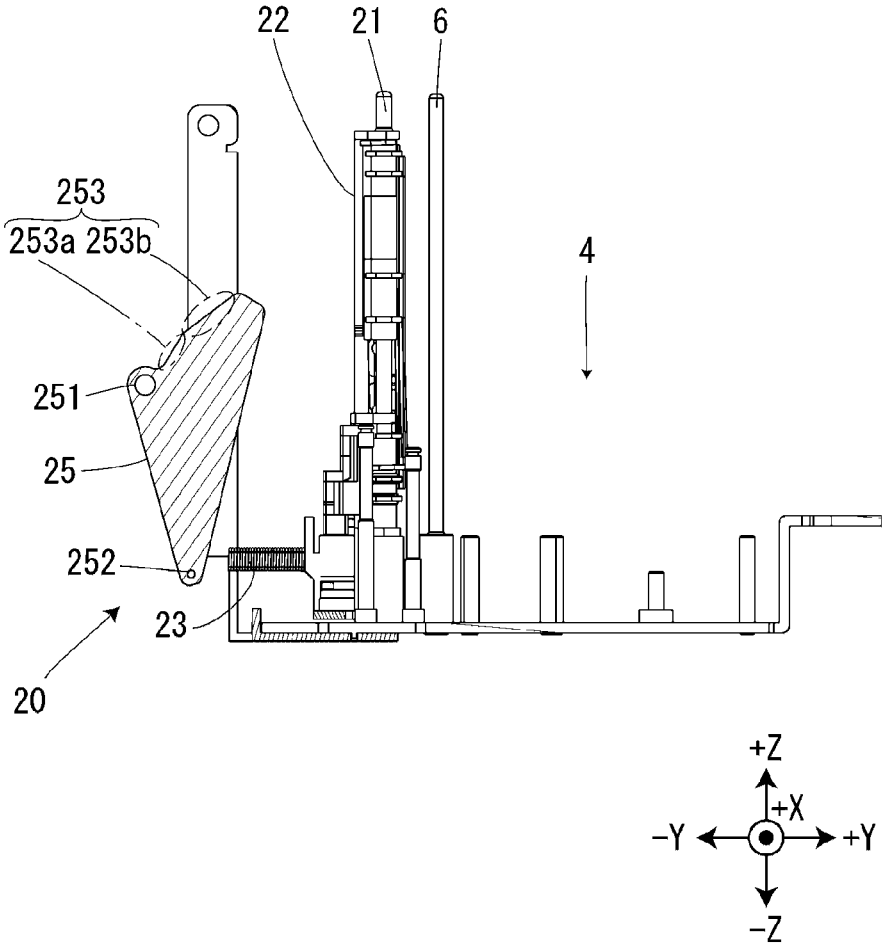
FIG. 11 is a sectional view of the head pressing mechanism in a state where the cover is opened and the tape cartridge is removed taken along line XI-XI of FIG. 8.

Out of three corners of the head pressing lever 25 formed in a substantially triangular plate shape, the lever shaft hole 251 is provided on a corner positioned on the most −Y side in a state where the head pressing spring 23 has contracted (refer to FIG. 11). The lever supporting shaft is inserted in the lever shaft hole 251, and the head pressing lever 25 rotates about the lever shaft hole 251 (in other words, about the lever supporting shaft).

Out of the three corners of the head pressing lever 25 formed in a substantially triangular plate shape, the pressing spring hooking hole 252 is provided on a corner positioned on the most −Z side in a state where the head pressing spring 23 has contracted (refer to FIG. 11). The end portion of the head pressing spring 23 on the −Y side is hooked to the pressing spring hooking hole 252.

Out of three sides of the head pressing lever 25 formed in a substantially triangular plate shape, the engaging region 253 is configured of a side opposing the corner where the pressing spring hooking hole 252 is provided. The engaging region 253 is a region that engages with the head pressing rib 26 when the cover 3 is closed. More specifically, the engaging region 253 includes a first engaging region **253*a* and a second engaging region 253*b* in order of being close to the lever shaft hole 251. The second engaging region 253*b* is connected to the first engaging region 253*a* so as to bend in a direction of separating away from the head pressing rib 26. In a case where the first tape cartridge 100*a* is mounted, a first engaging part 255, which engages with the head pressing rib 26 in a state where the cover 3 is closed, is included in the first engaging region 253*a* (refer to FIG. 9). In a case where the second tape cartridge 100*b* is mounted, a second engaging part 256, which engages with the head pressing rib 26 in a state where the cover 3 is closed, is included in the second engaging region 253*b* (refer to FIG. 10**).

Although details will be described later, the position (specifically, a rotation angle position) of the head pressing lever 25 differs between a case where the first tape cartridge **100*a* is mounted and a case where the second tape cartridge 100*b* is mounted. Consequently, the elastically deformed amount (specifically, a stretched amount) of the head pressing spring 23 differs between a case where the first tape cartridge 100*a* is mounted and a case where the second tape cartridge 100*b* is mounted. That is, when the cover 3 is closed in a case where the first tape cartridge 100*a* is mounted, the head pressing lever 25 is positioned at a first elastic position where the head pressing spring 23 is elastically deformed such that the elastically deformed amount of the head pressing spring 23 is a first deformed amount (refer to FIG. 9). In addition, when the cover 3 is closed in a case where the second tape cartridge 100***b* is mounted, the head pressing lever 25 is positioned at a second elastic position where the head pressing spring 23 is elastically deformed such that the elastically deformed amount of the head pressing spring 23 becomes a second deformed amount that is larger than the first deformed amount (refer to FIG. 10). When the cover 3 is opened, the head pressing lever 25 is positioned at a third elastic position where the head pressing spring 23 has contracted (refer to FIG. 11).

The head pressing rib 26 is rotatably (in other words, swingably) provided in the cover 3. That is, the head pressing rib 26 is rotatably supported by a rib supporting shaft (not illustrated), which is provided in the cover 3 and extends in the X-direction.

The head pressing rib 26 includes a rib shaft hole 261, a connecting portion 262, a lever side engagement portion 263, a cartridge side engagement portion 264, and a stopper side engagement portion 265.

The rib shaft hole 261 is provided on an end portion of the connecting portion 262 on the −Y side. The rib supporting shaft is inserted in the rib shaft hole 261, and the head pressing rib 26 rotates about the rib shaft hole 261 (in other words, about the rib supporting shaft).

The connecting portion 262 extends in a Y-direction, and connects the lever side engagement portion 263 and the cartridge side engagement portion 264 together. That is, the lever side engagement portion 263 is provided on the end portion of the connecting portion 262 on the −Y side, and the cartridge side engagement portion 264 is provided on an end portion of the connecting portion 262 on the +Y side.

The lever side engagement portion 263 protrudes from the end portion of the connecting portion 262 on the −Y side toward the −Z side. The lever side engagement portion 263 engages with (specifically, abuts against) the engaging region 253 of the head pressing lever 25 when the cover 3 is closed.

The cartridge side engagement portion 264 protrudes from the end portion on a side opposite to the lever side engagement portion 263 with respect to the rib shaft hole 261, that is, from the end portion of the connecting portion 262 on the +Y side toward a −X side. The cartridge side engagement portion 264 does not engage with the first tape cartridge 100*a* when the cover 3 is closed in a state where the first tape cartridge 100*a* is mounted on the cartridge mounting portion 4 (refer to FIG. 9). On the other hand, the cartridge side engagement portion 264 engages with (specifically, abuts against) the first wall portion 111 of the second tape cartridge 100*b* when the cover 3 is closed in a state where the second tape cartridge 100*b* is mounted on the cartridge mounting portion 4 (refer to FIG. 10). That is because the second tape cartridge 100*b* is thicker as described above. While the thickness (dimension in the Z-direction) of the cartridge case 105 is the first case thickness N1 in the case of the first cartridge case 105*a*, the thickness is the second case thickness N2 that is larger than the first case thickness N1 in the case of the second cartridge case 105*b*.

Figure 8:
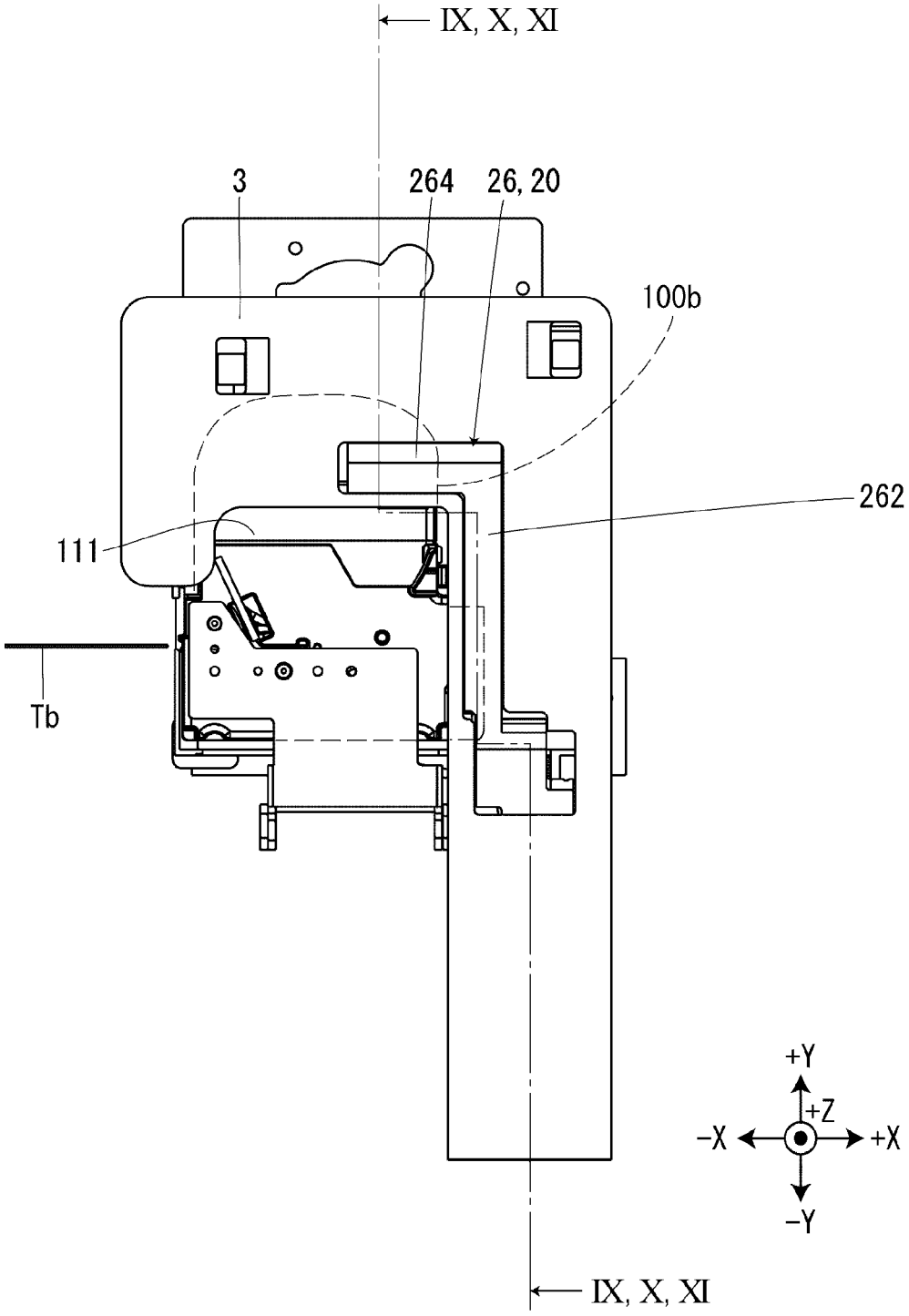
FIG. 8 is a view of the head pressing mechanism and the cover seen from the +Z side in a state where the second tape cartridge is mounted.

When engaging with the first wall portion 111 of the second tape cartridge 100*b*, the cartridge side engagement portion 264 engages with the first wall portion including a peripheral portion of the first wall portion 111 on the +X side (refer to FIG. 8). Consequently, in a case where the cover 3 is closed, the pressing against the second tape cartridge 100*b* from the head pressing rib 26 is received by the second wall portion 112 provided on the peripheral portion of the first wall portion 111. For this reason, the deflection of the first wall portion 111 caused by the pressing from the head pressing rib 26 can be suppressed.

The stopper side engagement portion 265 is configured of a surface on the +Z side of the end portion of the connecting portion 262 on the −Y side. The stopper side engagement portion 265 engages with (specifically, abuts against) a stopper portion 31 when the cover 3 is closed. The stopper portion 31 is provided on an inner surface of the cover 3, that is, a surface facing the −Z side in a state where the cover 3 is closed.

Although details will be described later, the position (specifically, a rotation angle position) of the head pressing rib 26 in a state where the cover 3 is closed differs between a case where the first tape cartridge 100*a* is mounted and a case where the second tape cartridge 100*b* is mounted. Consequently, the position of the head pressing lever 25 differs between a case where the first tape cartridge 100*a* is mounted and a case where the second tape cartridge 100*b* is mounted. That is, when the cover 3 is closed in a case where the first tape cartridge 100*a* is mounted, the head pressing rib 26 is positioned at a first engagement position where the stopper side engagement portion 265 engages with the stopper portion 31 (refer to FIG. 9). In this case, the head pressing rib 26 positions the head pressing lever 25 engaged with the lever side engagement portion 263 from the third elastic position to the first elastic position. On the other hand, when the cover 3 is closed in a case where the second tape cartridge 100*b* is mounted, the head pressing rib 26 is positioned at a second engagement position where the cartridge side engagement portion 264 engages with the second tape cartridge 100*b* (refer to FIG. 10). In this case, the head pressing rib 26 positions the head pressing lever 25 engaged with the lever side engagement portion 263 from the third elastic position to the second elastic position. In a case where the head pressing rib 26 is positioned at the second engagement position, the stopper side engagement portion 265 is separated away from the stopper portion 31.

Figure 9:
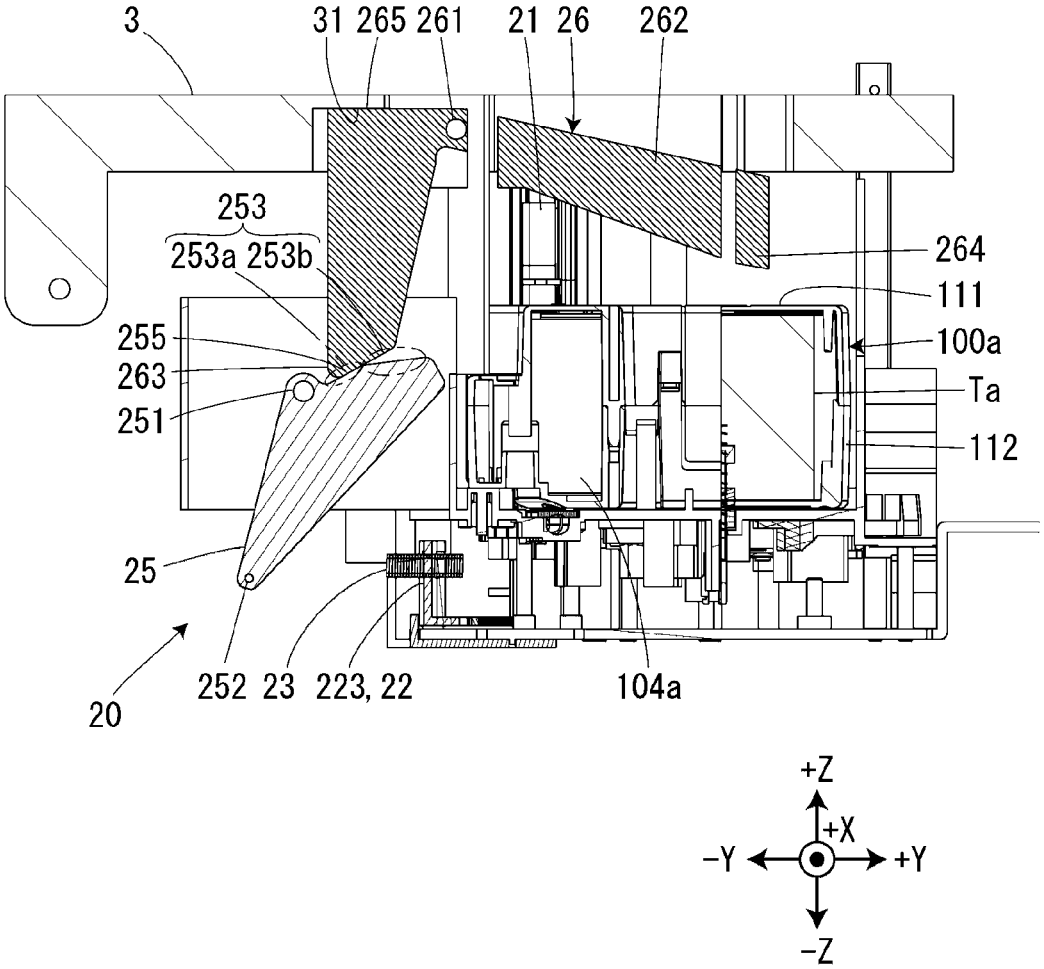
FIG. 9 is a sectional view of the head pressing mechanism and the cover in a state where the first tape cartridge is mounted taken along line IX-IX of FIG. 8.

When the cover 3 is closed, the elastically deformed head pressing spring 23 applies force to the head pressing rib 26 via the head pressing lever 25 in a direction where the stopper side engagement portion 265 approaches the stopper portion 31, that is, a clockwise direction of FIG. 9.

The movement of each unit of the head pressing mechanism 20 when the cover 3 is closed will be described based on FIGS. 9 and 10 by comparing a case where the first tape cartridge 100*a* is mounted and a case where the second tape cartridge 100*b* is mounted.

As illustrated in FIG. 9, when the cover 3 is closed in a state where the first tape cartridge 100*a* is mounted, the lever side engagement portion 263 of the head pressing rib 26 engages with the head pressing lever 25, which is at the third elastic position, and the lever side engagement portion 263 is pushed by the head pressing lever 25 toward the relatively +Z side. Accordingly, the head pressing rib 26 rotates in the direction where the stopper side engagement portion 265 approaches the stopper portion 31. By the stopper side engagement portion 265 engaging with the stopper portion 31, the head pressing rib 26 is positioned at the first engagement position.

When the cover 3 is further closed in this state, the engaging region 253 of the head pressing lever 25 is pushed by the head pressing rib 26 toward the −Z side and the head pressing lever 25 rotates from the third elastic position to the first elastic position. Then, with the head pressing rib 26 being positioned at the first engagement position and the cartridge side engagement portion 264 not engaging with the first tape cartridge 100*a*, the cover 3 is completely closed and the cover 3 is locked by the cover lock mechanism. At this time, the head pressing lever 25 is positioned at the first elastic position by the head pressing rib 26 being positioned at the first engagement position. For this reason, the elastically deformed amount of the head pressing spring 23 is the first deformed amount. The thermal head 5 is pressed against the first platen roller 104*a* at first head pressing force by the head pressing spring 23 being elastically deformed by the first deformed amount.

Also in a case where the tape cartridge 100, of which the platen roller 104 is even shorter and the cartridge case 105 is even thinner than those of the first tape cartridge 100*a*, is mounted, the cartridge side engagement portion 264 does not engage with the first tape cartridge 100*a*. For this reason, also in this case, the thermal head 5 is pressed against the platen roller 104 at the first head pressing force as in a case where the first tape cartridge 100*a* is mounted.

Figure 10:
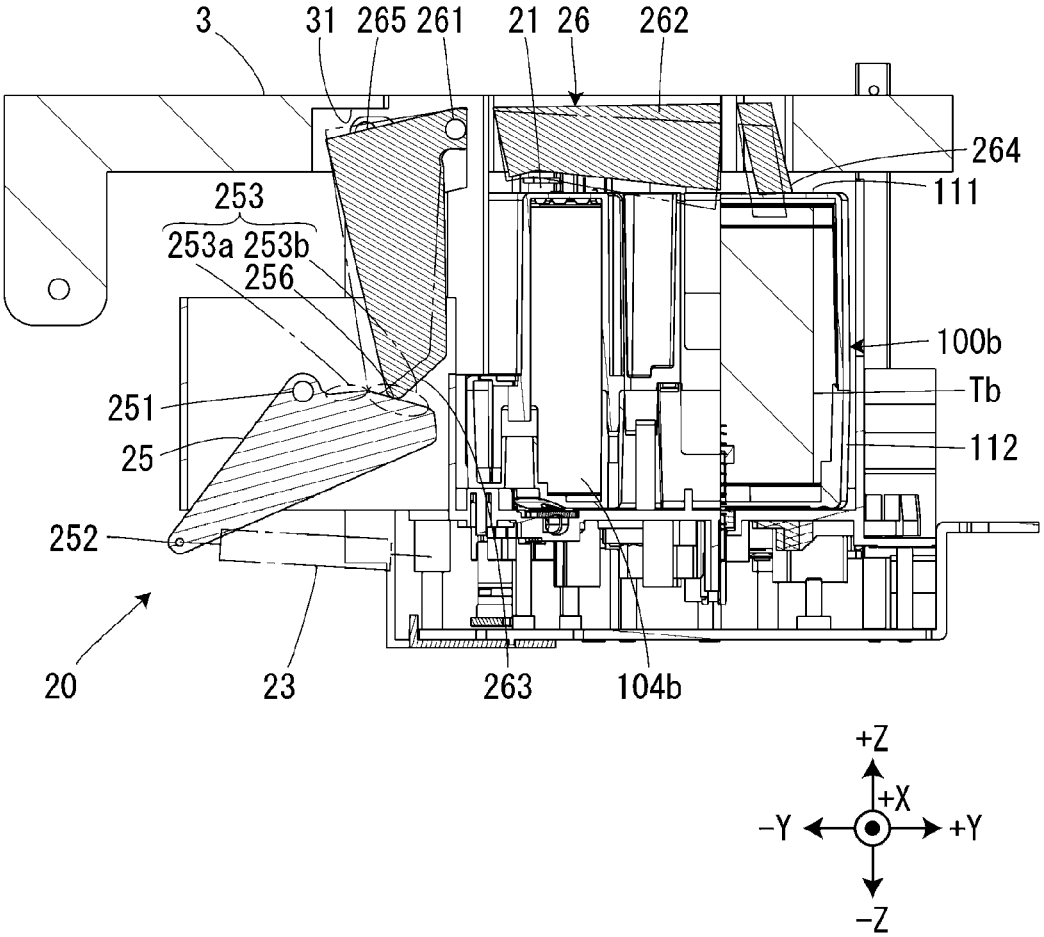
FIG. 10 is a sectional view of the head pressing mechanism and the cover in a state where the second tape cartridge is mounted taken along line X-X of FIG. 8.

On the other hand, as illustrated in FIG. 10, when the cover 3 is closed in a state where the second tape cartridge 100*b* is mounted, the head pressing lever 25 engaged with the head pressing rib 26 rotates from the third elastic position to the first elastic position after the head pressing rib 26 is positioned at the first engagement position as in a case where the first tape cartridge 100*a* is mounted. Then, before the cover 3 is completely closed, the cartridge side engagement portion 264 engages with the second tape cartridge 100*b*. Consequently, the cartridge side engagement portion 264 is pushed by the second tape cartridge 100*b* toward the relatively +Z side, the head pressing rib 26 rotates in a direction where the stopper side engagement portion 265 separates away from the stopper portion 31 and is positioned at the second engagement position. A configuration where the cartridge side engagement portion 264 engages with the second tape cartridge 100*b* and the head pressing rib is positioned at the second engagement position before the head pressing rib 26 is positioned at the first engagement position, that is, before the stopper side engagement portion 265 engages with the stopper portion 31 may be adopted.

The cover 3 is completely closed in this state, and the cover 3 is locked by the cover lock mechanism. At this time, the head pressing lever 25 further rotates beyond the first elastic position and is positioned at the second elastic position by the head pressing rib 26 being positioned at the second engagement position. For this reason, the elastically deformed amount of the head pressing spring 23 is the second deformed amount that is larger than the first deformed amount. The thermal head 5 is pressed against the second platen roller 104*b* at second head pressing force that is larger than the first head pressing force by the head pressing spring 23 being elastically deformed by the second deformed amount.

When the head pressing rib 26 rotates from the first engagement position to the second engagement position, the head pressing lever 25 rotates from the first elastic position to the second elastic position while shifting an engaging part with the head pressing rib 26 from first engaging part 255 to the second engaging part 256. In a case where the head pressing lever 25 engages with the head pressing rib 26 in the first engaging region 253*a* at this time, the head pressing lever 25 rotates by a first rotation amount with respect to a unit rotation amount (for example, 1°) of the head pressing rib 26. On the contrary, in a case where the head pressing lever 25 engages with the head pressing rib 26 in the second engaging region 253*b*, the head pressing lever 25 rotates by a second rotation amount that is smaller than the first rotation amount with respect to the unit rotation amount of the head pressing rib 26. That is because, as described above, the second engaging region 253*b* is connected to the first engaging region 253*a* so as to bend in the direction of separating away from the head pressing rib 26. In other words, the second engaging region 253*b* is formed in a shape along the movement locus of the lever side engagement portion 263 of the head pressing rib 26. For this reason, even when the position of the head pressing rib 26 differs within an area where the head pressing rib engages with the head pressing lever 25 in the second engaging region 253*b*, the position of the head pressing lever 25 mostly does not change.

For this reason, also in a case where the head pressing rib is rotated only to a position immediately in front of the second engagement position, that is, a case where the head pressing rib is rotated only to a position where the head pressing rib engages with the head pressing lever 25 on an immediately front side of the second engaging part 256 in the second engaging region 253*b*, due to an effect of friction after the head pressing rib 26 engages with the second tape cartridge 100*b*, the head pressing lever 25 is positioned at the second elastic position, or in the vicinity of the second elastic position. As a result, a difference between the second deformed amount in a case where the head pressing rib 26 is rotated only to a position immediately in front of the second engagement position and the second deformed amount in a case where the head pressing rib 26 is rotated to the second engagement position is smaller. Therefore, a difference between the second head pressing force in a case where the head pressing rib 26 is rotated only to a position immediately in front of the second engagement position and the second head pressing force in a case where the head pressing rib 26 is rotated to the second engagement position can be made smaller. The head pressing rib 26 in a case where the head pressing rib is rotated only to a position immediately in front of the second engagement position is illustrated with a two-dot chain line in FIG. 10.

As described above, in the head pressing mechanism 20 of the embodiment, the thermal head 5 is pressed against the first platen roller 104*a* at the first head pressing force in a case where the first tape cartridge 100*a* accommodating the first platen roller 104*a* having the first roller length L1 is mounted on the cartridge mounting portion 4. On the other hand, the thermal head 5 is pressed against the second platen roller 104*b* at the second head pressing force that is larger than the first head pressing force in a case where the second tape cartridge 100*b* accommodating the second platen roller 104*b* having the second roller length L2 is mounted on the cartridge mounting portion 4.

According to this configuration, the head pressing force of pressing the thermal head 5 against the first platen roller 104*a* or the second platen roller 104*b* differs. The head pressing force is the first head pressing force in a case where the first tape cartridge 100*a* accommodating the first platen roller 104*a* is mounted, and is the second head pressing force that is larger than the first head pressing force in a case where the second tape cartridge 100*b* accommodating the second platen roller 104*b* is mounted. Therefore, also in a case where the length of the platen roller 104 differs, variations in a pressure received by the platen roller 104 from the thermal head 5 can be made smaller. Consequently, the tape printing apparatus A can perform printing while suppressing variations in print density.

A configuration where the thermal head 5 is pressed against the first platen roller 104*a* or the second platen roller 104*b* at the second head pressing force is assumed in both of a case where the first tape cartridge 100*a* is mounted and a case where the second tape cartridge 100*b* is mounted, as a comparative example of the embodiment. In the comparative example, in a case where the first tape cartridge 100*a* is mounted, the first platen roller 104*a* has a length that is smaller than the first roller length L1 and has a small pressure receiving area. Thus, the first platen roller 104*a* receives an excessive pressure from the thermal head 5 and print density becomes excessively high. On the contrary, as described above, since the thermal head 5 is pressed against the platen roller 104 at head pressing force corresponding to the length of the platen roller 104 in the embodiment, a pressure received by the platen roller 104 from the thermal head 5 can be kept within a desired range and the print density can be kept within a desired range even in a case where the length of the platen roller 104 differs.

As in the comparative example, when a pressure received by the first platen roller 104*a* from the thermal head 5 becomes excessively high in a case where the first tape cartridge 100*a* is mounted, there is a possibility that the first ink ribbon Ra is destroyed by an edge of the thermal head 5 in a case where the first tape Ta and the first ink ribbon Ra are reversely fed. On the contrary, in the embodiment, since an excessively high pressure received by the first platen roller 104*a* from the thermal head 5 is suppressed also in a case where the first tape cartridge 100*a* is mounted, the destruction of the first ink ribbon Ra can be suppressed in a case where the first tape Ta and the first ink ribbon Ra are reversely fed.

The head pressing spring 23 is an example of an "elastic body" of the invention. The head pressing lever 25 is an example of an "elastic side member" of the invention. The head pressing rib 26 is an example of a "cover side member" of the invention.

The invention is not limited to the embodiment, and can adopt various configurations without departing from the spirit of the invention. For example, the embodiment can be changed into the following form in addition to the form described above.

When the head pressing lever 25 has rotated from the third elastic position and has reached the second elastic position, a stopper with which the head pressing lever 25 engages (specifically, abuts against) may be provided within a rotation area of the head pressing lever 25. Consequently, the head pressing lever 25 can be restricted to the second elastic position.

Without being limited to a configuration where the head pressing lever 25 rotates so as to be positioned at the first elastic position and the second elastic position by rotation, for example, a configuration where the head pressing lever slides in a contracting direction of the head pressing spring 23 so as to be positioned at the first elastic position and the second elastic position may be adopted.

Without being limited to a configuration where the head pressing mechanism 20 switches head pressing force of pressing the thermal head 5 against the platen roller 104 between two levels of force, such as the first head pressing force and the second head pressing force, a configuration where the head pressing mechanism switches among three or more levels of force may be adopted.

The head pressing mechanism 20 is not limited to a configuration where the thermal head 5 is pressed against the platen roller 104 in tandem with the closing of the cover 3. For example, a configuration where the thermal head 5 is pressed against the platen roller 104 in tandem with the mounting of the tape cartridge 100 (in other words, before the cover 3 is closed) by providing an operation member that engages with the tape cartridge 100 mounted on the cartridge mounting portion 4 may be adopted. In this case, how the operation member operates differs between a case where the first tape cartridge 100*a* is mounted and a case where the second tape cartridge 100*b* is mounted. Consequently, when the first tape cartridge 100*a* is mounted, the thermal head 5 can be pressed against the platen roller 104 at the second head pressing force, and when the second tape cartridge 100*b* is mounted, the thermal head 5 is pressed against the platen roller 104 at the first head pressing force.

Without being limited to a tension coil spring such as the head pressing spring 23, for example, a compression coil spring may be used as the elastic body for pressing the thermal head 5 against the platen roller 104. In addition, without being limited to a spring, for example, rubber may be used as the elastic body.

A head pressing mechanism 20A, which is a modification example of the head pressing mechanism 20, will be described based on FIGS. 12 to 16. Hereinafter, as for the head pressing mechanism 20A, description on portions configured the same as the head pressing mechanism 20 will be omitted as appropriate and different portions will be mainly described.

The head pressing mechanism 20A includes the head supporting shaft 21, a first head mechanism 40*a*, a second head mechanism 40*b*, the head releasing spring 24, the head pressing rib 26, and a rib pressing spring 28.

The head supporting shaft 21 rotatably supports a first head frame 22*a* and a second head frame 22*b* to be described later.

The first head mechanism 40*a* presses the thermal head 5 against the first platen roller 104*a* when the cover 3 is closed in a state where the first tape cartridge 100*a* is mounted on the cartridge mounting portion 4. The second head mechanism 40*b* presses the thermal head 5 against the second platen roller 104*b* when the cover 3 is closed in a state where the second tape cartridge 100*b* is mounted on the cartridge mounting portion 4.

The first head mechanism 40*a* includes the first head frame 22*a*, a first head pressing spring 23*a*, and a first head pressing lever 25*a*.

The first head frame 22*a* is rotatably supported by the head supporting shaft 21. The first head frame 22*a* includes a first frame portion 221*a* and a first arm portion 222*a*.

The first frame portion 221*a* is positioned between a second frame portion 221*b* to be described later and the thermal head 5 supported by the second frame portion 221*b*, and extends in the Z-direction. Two pressing portions 224*a* (only one is illustrated in FIG. 12) protruding toward a platen shaft 6 side (+Y side) are provided on an end portion of the first frame portion 221*a* on the +Z side. A tip portion of the pressing portion 224*a* is formed in a substantially arc when seen from the X-direction.

The first arm portion 222*a* extends from an end portion of the first frame portion 221*a* on the −Z side toward the +X side. An end portion of the first head pressing spring 23*a* on the +Y side is hooked to a first arm tip portion 223*a* which is an end portion of the first arm portion 222*a* on the +X side.

The first head pressing spring 23*a* is an elastic body for pressing the thermal head 5 against the first platen roller 104*a* via the first head frame 22*a*. The first head pressing spring 23*a* is provided from the first arm tip portion 223*a* toward the −Y side. An end portion of the first head pressing spring 23*a* on the −Y side is hooked to the first head pressing lever 25*a*. When the first head pressing lever 25*a* pulls the first head pressing spring 23*a* and the first head pressing spring 23*a* stretches, force is applied to the first arm tip portion 223*a* toward the −Y side and the first head frame 22*a* is rotated in the head pressing direction, that is, a clockwise direction of FIG. 13. For example, a tension coil spring can be used as the first head pressing spring 23*a*.

The first head pressing lever 25*a* is rotatably supported by a first lever supporting shaft (not illustrated) extending in an X-direction. When the first head pressing lever 25*a* rotates in a counterclockwise direction of FIG. 14 in a state where the first head pressing spring 23*a* has contracted, the first head pressing spring 23*a* stretches. On the other hand, when the first head pressing lever 25*a* rotates in a clockwise direction of FIG. 14, the first head pressing spring 23*a* contracts.

The first head pressing lever 25*a* includes a first lever shaft hole 251*a*, a first pressing spring hooking hole 252*a*, and a first engaging portion 254*a*. The first lever supporting shaft is inserted in the first lever shaft hole 251*a*, and the first head pressing lever 25*a* rotates about the first lever shaft hole 251*a*. The end portion of the first head pressing spring 23*a* on the −Y side is hooked to the first pressing spring hooking hole 252*a*. The first engaging portion 254*a* is a portion that engages with the head pressing rib 26 when the cover 3 is closed in a state where the first tape cartridge 100*a* is mounted on the cartridge mounting portion 4.

The second head mechanism 40*b* includes the second head frame 22*b*, a second head pressing spring 23*b*, and a second head pressing lever 25*b*.

The second head frame 22*b* is rotatably supported by the head supporting shaft 21, and swingably holds the thermal head 5. The second head frame 22*b* includes the second frame portion 221*b* and a second arm portion 222*b*.

The second frame portion 221*b* extends in the Z-direction, and holds the thermal head 5 on the platen shaft 6 side (+Y side) thereof. That is, two connection portions 224*b* (only one is illustrated in FIG. 12) protruding toward the platen shaft 6 side are provided on a substantially intermediate portion of the second frame portion 221*b* in the Z-direction, and the thermal head 5 is connected to the connection portion 224*b* so as to be swingable with the connection portion 224*b* as a swinging center. For this reason, when the thermal head 5 is pressed against the platen roller 104, the thermal head 5 swings according to an inclination of the platen roller 104, and comes into a state of following the platen roller 104. Consequently, the thermal head 5 is evenly pressed against the platen roller 104.

The second arm portion 222*b* extends from an end portion of the second frame portion 221*b* on the −Z side toward the +X side. The second arm portion 222*b* is provided on the +Z side of the first arm portion 222*a*. An end portion of the second head pressing spring 23*b* on the +Y side is hooked to a second arm tip portion 223*b* which is an end portion of the second arm portion 222*b* on the +X side. The second arm tip portion 223*b* is provided on the −X side of the first arm tip portion 223*a*.

The second head pressing spring 23*b* is an elastic body for pressing the thermal head 5 against the platen roller 104 via the second head frame 22*b*. The second head pressing spring 23*b* is provided from the second arm tip portion 223*b* toward the −Y side. An end portion of the second head pressing spring 23*b* on the −Y side is hooked to the second head pressing lever 25*b*. When the second head pressing lever 25*b* pulls the second head pressing spring 23*b* and the second head pressing spring stretches, force is applied to the second arm tip portion 223*b* toward the −Y side and the second head frame 22*b* is rotated in the head pressing direction, that is, the clockwise direction of FIG. 13. The second head pressing spring 23*b* has a spring constant larger than the first head pressing spring 23*a*. For example, a tension coil spring can be used as the second head pressing spring 23*b*.

The second head pressing lever 25*b* is provided on the −X side of the first head pressing lever 25*a*. The second head pressing lever 25*b* is rotatably supported by a second lever supporting shaft (not illustrated) extending in the X-direction. When the second head pressing lever 25*b* rotates in the counterclockwise direction of FIG. 14 in a state where the second head pressing spring 23*b* has contracted, the second head pressing spring 23*b* stretches. On the other hand, when the second head pressing lever 25*b* rotates in the clockwise direction of FIG. 14, the second head pressing spring 23*b* contracts.

The second head pressing lever 25*b* includes a second lever shaft hole 251*b*, a second pressing spring hooking hole 252*b*, and a second engaging portion 254*b*. The second lever supporting shaft is inserted in the second lever shaft hole 251*b*, and the second head pressing lever 25*b* rotates about the second lever shaft hole 251*b*. The end portion of the second head pressing spring 23*b* on the −Y side is hooked to the second pressing spring hooking hole 252*b*. The second engaging portion 254*b* is a portion that engages with the head pressing rib 26 when the cover 3 is closed in a state where the second tape cartridge 100*b* is mounted on the cartridge mounting portion 4.

The head releasing spring 24 is an elastic body for separating the thermal head 5 away from the platen roller 104. The head releasing spring 24 is a torsion coil spring wound around the head supporting shaft 21, and applies force to the second head frame 22*b* in the head releasing direction opposite to the head pressing direction, that is, the counterclockwise direction of FIG. 13.

The head pressing rib 26 is rotatably provided in the cover 3. The head pressing rib 26 includes a rib shaft projection 266, the connecting portion 262, the lever side engagement portion 263, the cartridge side engagement portion 264, and a spring attaching portion 267.

The rib shaft projection 266 engages with a shaft attaching portion (not illustrated) provided in the cover 3. The head pressing rib 26 rotates about the rib shaft projection 266. The connecting portion 262 extends in the Y-direction, and connects the lever side engagement portion 263 and the cartridge side engagement portion 264 together.

The lever side engagement portion 263 protrudes from the end portion of the connecting portion 262 on the −Y side toward the −Z side. The lever side engagement portion 263 engages with the first head pressing lever 25*a* and does not engage with the second head pressing lever 25*b* when the cover 3 is closed in a state where the first tape cartridge 100*a* is mounted on the cartridge mounting portion 4 (refer to FIG. 15). The lever side engagement portion 263 does not engage with the first head pressing lever 25*a* and engages with the second head pressing lever 25*b* when the cover 3 is closed in a state where the second tape cartridge 100*b* is mounted on the cartridge mounting portion 4 (refer to FIG. 16). As in the case when the first tape cartridge 100*a* is mounted, the lever side engagement portion 263 engages with the first head pressing lever 25*a* and does not engage with the second head pressing lever 25*b* when the cover 3 is closed in a state where the first tape cartridge 100 is not mounted on the cartridge mounting portion 4 (refer to FIG. 14).

The cartridge side engagement portion 264 protrudes from the end portion of the connecting portion 262 on the +Y side toward the −X side. The cartridge side engagement portion 264 does not engage with the first tape cartridge 100*a* when the cover 3 is closed in a state where the first tape cartridge 100*a* is mounted on the cartridge mounting portion 4 (refer to FIG. 15). On the other hand, the cartridge side engagement portion 264 engages with the second tape cartridge 100*b* in the middle of closing the cover 3 in a state where the second tape cartridge 100*b* is mounted on the cartridge mounting portion 4 (refer to FIG. 16). That is because, as described above, the second tape cartridge 100*b* is thicker than the first tape cartridge 100*a*.

Figure 17:
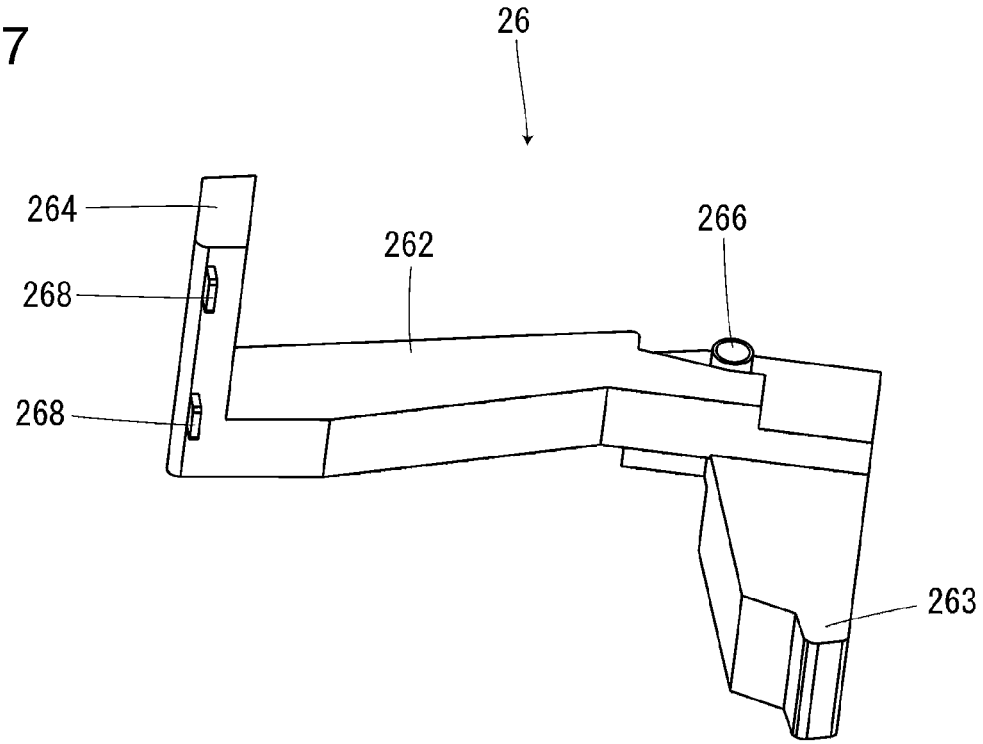
FIG. 17 is a perspective view of a head pressing rib.

As illustrated in FIG. 17, one or a plurality of (two in FIG. 17) engagement projections 268 may be provided on the cartridge side engagement portion 264. The engagement projections 268 engage with engagement recesses (not illustrated) provided in the first wall portion 111 or the second wall portion 112 of the second tape cartridge 100*b*. Consequently, when the cover 3 is closed also in a case where the second tape cartridge 100*b* is not appropriately mounted to the inside of the cartridge mounting portion 4, the head pressing rib 26 can effectively push the second tape cartridge 100*b* to the inside of the mounting direction in a state where the engagement projections 268 are engaged with the engagement recesses. The engagement projection 268 is an example of a "first engagement portion" of the invention and the engagement recess is an example of a "second engagement portion" of the invention. The shape of the first engagement portion provided on the cartridge side engagement portion 264 is not limited to a projection, and may be a shape complementary to the shape of the second engagement portion provided on the second tape cartridge 100*b*. For example, the first engagement portion may be a recess and the second engagement portion may be a projection.

It is preferable that the cartridge side engagement portion 264 engage with a region close to the centroid of the second tape cartridge 100*b*, in the first wall portion 111 of the second tape cartridge 100*b*, for example, a region between the center of the tape core 101 and the center of the platen roller 104 in a length direction (Y-direction) of the second tape cartridge 100*b*. According to this, the second tape cartridge can be appropriately pushed to the inside of the cartridge mounting portion 4 without the second tape cartridge 100*b* being inclined.

Referring back to FIGS. 12 to 16, the spring attaching portion 267 protrudes toward a surface on the +Z side of the end portion of the connecting portion 262 on the +Y side. The rib pressing spring 28 is attached to the spring attaching portion 267.

One end of the rib pressing spring 28 is attached to the spring attaching portion 267, and the other end is attached to the inner surface of the cover 3. The rib pressing spring 28 applies force to the head pressing rib 26 in a direction where the cartridge side engagement portion 264 approaches a bottom surface side (−Z side) of the cartridge mounting portion 4, that is, the counterclockwise direction of FIG. 14. For example, a compression coil spring can be used as the rib pressing spring 28. A torsion coil spring provided in the rib shaft projection 266 may be used as the rib pressing spring 28.

Figure 15:
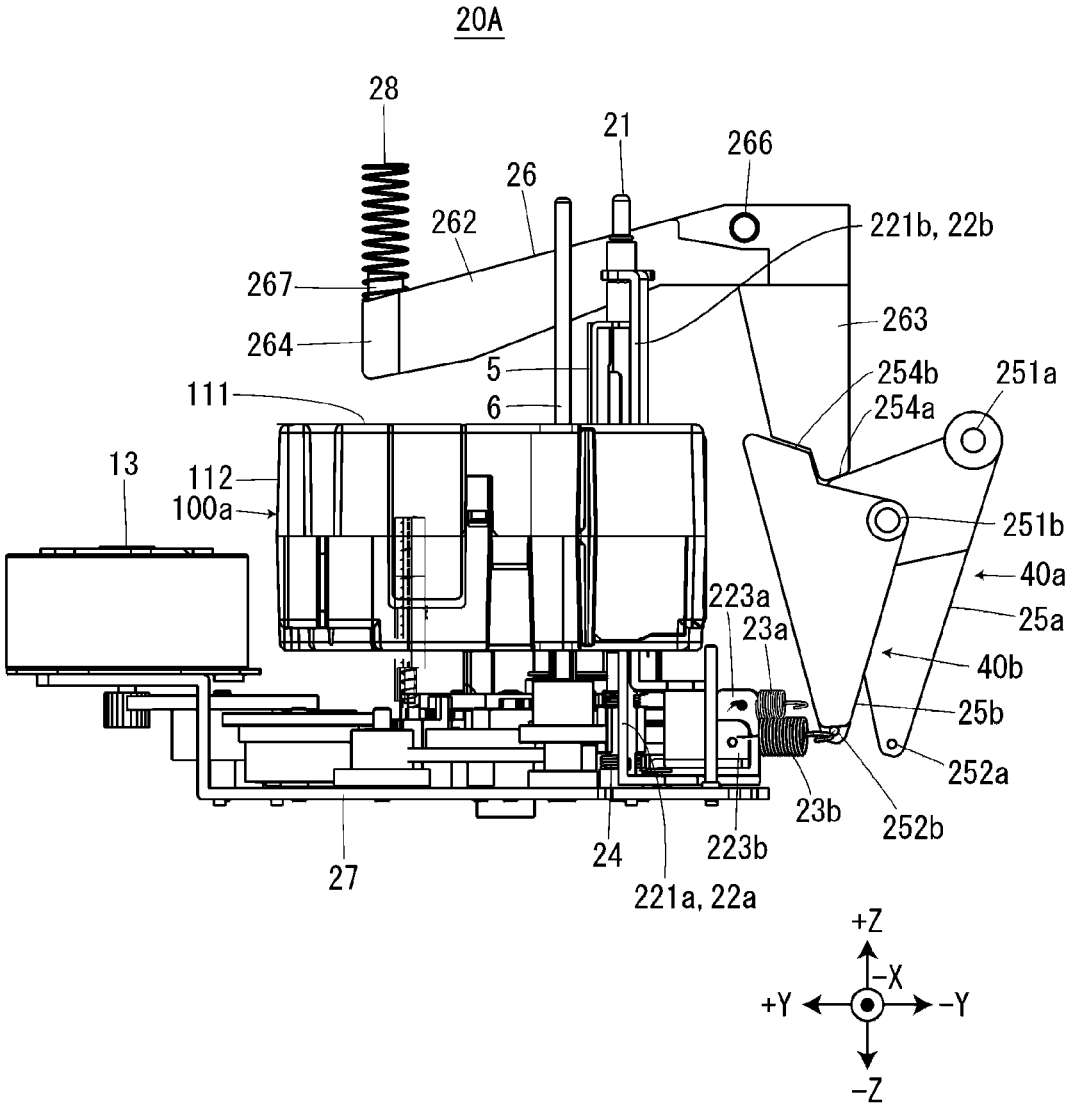
FIG. 15 is a view of the head pressing mechanism of the modification example seen from the −X side in a state where the first tape cartridge is mounted.

As illustrated in FIG. 15, when the cover 3 is closed in a state where the first tape cartridge 100*a* is mounted on the cartridge mounting portion 4, the cartridge side engagement portion 264 does not engage with the first tape cartridge 100*a* as described above. Thus, the head pressing rib 26 comes into a state of being rotated in a counterclockwise direction by the rib pressing spring 28. At this time, the lever side engagement portion 263 engages with the first head pressing lever 25*a* and does not engage with the second head pressing lever 25*b*. When the cover 3 is closed in a state where the first tape cartridge 100*a* is mounted on the cartridge mounting portion 4, the head pressing rib 26 is positioned at the first engagement position where the lever side engagement portion 263 engages with the first head pressing lever 25*a*.

Figure 16:
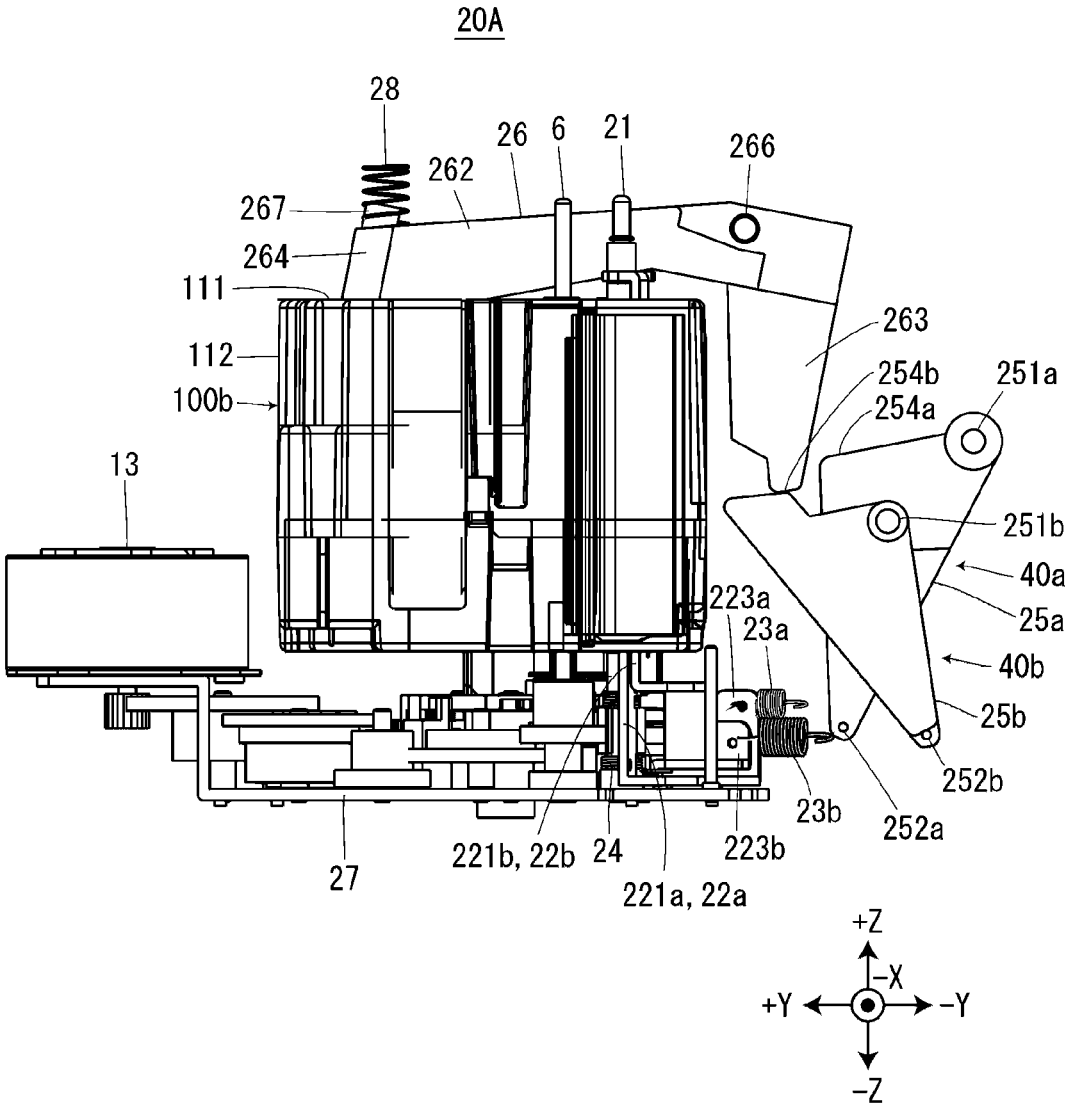
FIG. 16 is a view of the head pressing mechanism of the modification example seen from the −X side in a state where the second tape cartridge is mounted.

On the other hand, as illustrated in FIG. 16, in the middle of closing the cover 3 in a state where the second tape cartridge 100*b* is mounted on the cartridge mounting portion 4, the cartridge side engagement portion 264 engages with the second tape cartridge 100*b* as described above. Thus, the head pressing rib 26 comes into a state of being rotated in a counterclockwise direction from the first engagement position against the rib pressing spring 28. When the cover 3 is further closed in this state, the lever side engagement portion 263 does not engage with the first head pressing lever 25*a* and engages with the second head pressing lever 25*b*. When the cover 3 is closed in a state where the second tape cartridge 100*b* is mounted on the cartridge mounting portion 4, the head pressing rib 26 is positioned at the second engagement position where the lever side engagement portion 263 engages with the second head pressing lever 25*b*.

Figure 18:
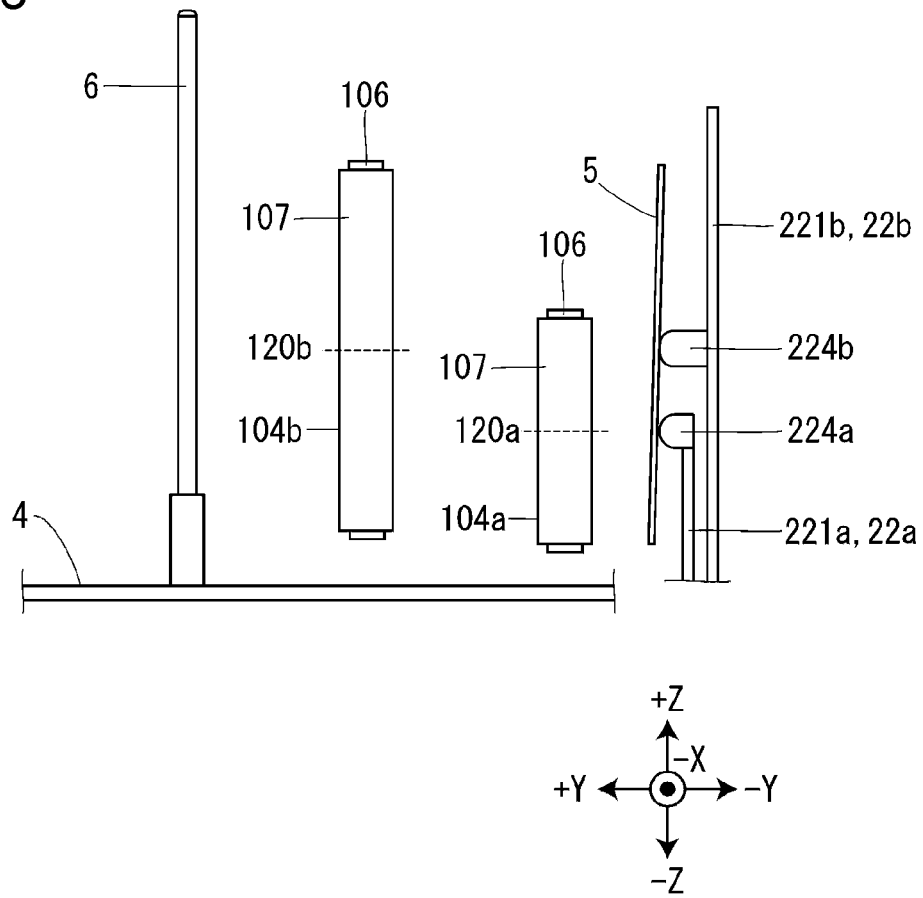
FIG. 18 is a view schematically illustrating a positional relationship between a platen roller in the tape cartridge mounted on a cartridge mounting portion and a connection portion and a pressing portion, in the head pressing mechanism of the modification example.

A positional relationship between the platen roller 104 in the tape cartridge 100 mounted on the cartridge mounting portion 4 and the connection portion 224*b* and the pressing portion 224*a* will be described based on FIG. 18. In FIG. 18, the platen shaft 6, the first platen roller 104*a*, and the second platen roller 104*b* are illustrated side by side for convenience of description.

Herein, a center portion (in a strict sense, a center portion of the roller body 107 of the first platen roller 104*a*) of the first platen roller 104*a*, which is in the first tape cartridge 100*a* mounted on the cartridge mounting portion 4, in the shaft direction (Z-direction) of the platen shaft 6 will be referred to as a first center portion 120*a*. A center portion (in a strict sense, a center portion of the roller body 107 of the second platen roller 104*b*) of the second platen roller 104*b*, which is in the second tape cartridge 100*b* mounted on the cartridge mounting portion 4, in the shaft direction of the platen shaft 6 will be referred to as a second center portion 120*b*. The first center portion 120*a* is positioned closer to the bottom surface side (in other words, the inside of the mounting direction) of the cartridge mounting portion 4 than the second center portion 120*b* is positioned in the shaft direction of the platen shaft 6.

The pressing portion 224*a* is provided closer to the first center portion 120*a* than the second center portion 120*b* in the shaft direction of the platen shaft 6. That is, a distance between the pressing portion 224*a* and the first center portion 120*a* is shorter than a distance between the pressing portion 224*a* and the second center portion 120*b* in the shaft direction of the platen shaft 6. It is more preferable that the pressing portion 224*a* be provided at a position that matches the first center portion 120*a* in the shaft direction of the platen shaft 6.

The connection portion 224*b* is provided closer to the second center portion 120*b* than the first center portion 120*a* in the shaft direction of the platen shaft 6. That is, a distance between the connection portion 224*b* and the second center portion 120*b* is shorter than a distance between the connection portion 224*b* and the first center portion 120*a* in the shaft direction of the platen shaft 6. It is more preferable that the connection portion 224*b* be provided at a position that matches the second center portion 120*b* in the shaft direction of the platen shaft 6.

The movement of each unit of the head pressing mechanism 20A in a case where the cover 3 is opened will be described based on FIG. 19. The first head pressing lever

Figure 19:
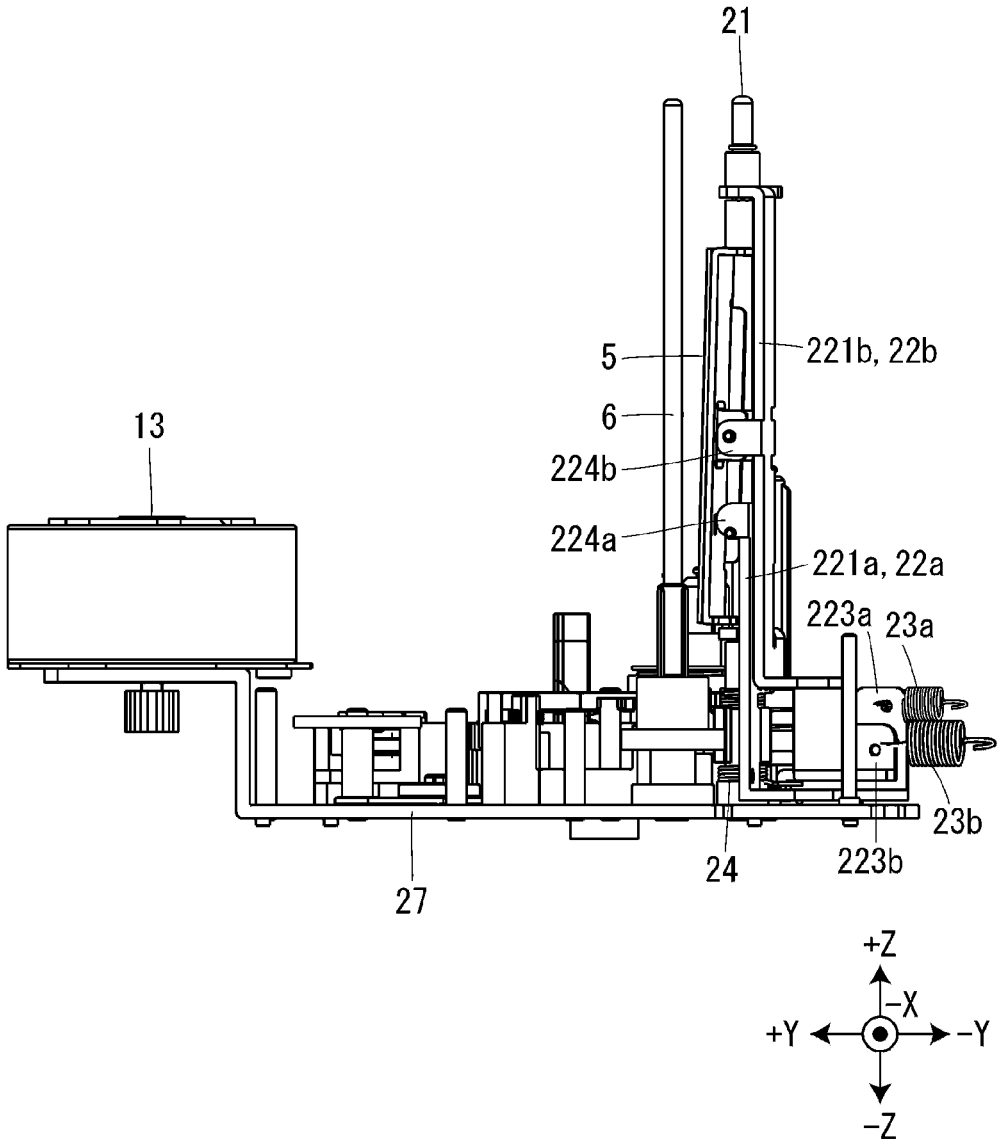
FIG. 19 is a view of the head pressing mechanism of the modification example seen from the −X side in a state where the cover is opened.

25*a*, the second head pressing lever 25*b*, and the head pressing rib 26 will not be illustrated in FIG. 19.

The head releasing spring 24 applies force to the second head frame 22*b* in the head releasing direction as described above. For this reason, when the cover 3 is opened, the second head frame 22*b* rotates in the head releasing direction until the second head frame hits a second stopper (not illustrated) and is positioned at a desired second release position. At this time, the pressing portion 224*a* of the first head frame 22*a* is pushed by the thermal head 5 held by the second head frame 22*b*. For this reason, the first head frame 22*a* follows the second head frame 22*b* and rotates in the head releasing direction until the second head frame hits a first stopper (not illustrated) and is positioned at a desired first release position.

In a state where the first head frame 22*a* is positioned at the first release position and a state where the second head frame 22*b* is positioned at the second release position, the pressing portion 224*a* of the first head frame 22*a* is in contact with the reverse side (−Y side) of the thermal head 5 at a position closer to the platen shaft 6 than the connection portion 224*b* of the second head frame 22*b* is positioned. As described above, the pressing portion 224*a* is positioned closer to the inside (−Z side) of the mounting direction than the connection portion 224*b* is positioned.

For this reason, when the cover 3 is opened, the thermal head 5 that is swingably connected to the connection portion 224*b* takes an inclined posture in which an end portion on the inside (−Z side) of the mounting direction approaches the platen shaft 6 and an end portion on the immediately front side (+Z side) of the mounting direction is separated away from the platen shaft 6. Consequently, an interval between the end portion of the thermal head 5 on the immediately front side of the mounting direction and the platen shaft 6 is wider compared to a case where the thermal head 5 takes a posture in which the thermal head is in parallel with the platen shaft 6. Therefore, when mounting/detaching the tape cartridge 100 onto/from the cartridge mounting portion 4, the tape T or the ink ribbon R getting caught in the end portion of the thermal head 5 on the immediately front side of the mounting direction is suppressed. For this reason, a user can easily perform a mounting/detaching operation of the tape cartridge 100 onto/from the cartridge mounting portion 4. In addition, the generation of creases in the ink ribbon R can be suppressed and print quality can be stabilized.

The pressing portion 224*a* functions as a "head contact portion" of the invention. Instead of the pressing portion 224*a*, a member (for example, a projection provided on the exterior), which is positioned closer to the inside of the mounting direction than the connection portion 224*b* is positioned and makes the thermal head 5 take an inclined posture in which the end portion on the inside of the mounting direction approaches the platen shaft 6 and the end portion on the immediately front side of the mounting direction is separated away from the platen shaft 6 by coming into contact with the thermal head 5 when the cover 3 is opened, may function as a "head contact portion" of the invention.

The movement of each unit of the head pressing mechanism 20A in a case where the cover 3 is closed in a state where the first tape cartridge 100*a* is mounted on the cartridge mounting portion 4 will be described based on FIG. 15.

When the cover 3 is closed in a state where the first tape cartridge 100*a* is mounted, the head pressing rib 26 is positioned at the first engagement position as described above. Thus, the lever side engagement portion 263 engages with the first head pressing lever 25*a*. Consequently, the first head pressing lever 25*a* rotates in the counterclockwise direction of FIG. 15, and the first head pressing spring 23*a* stretches. For this reason, the thermal head 5 is pressed against the first platen roller 104*a* by the first head frame 22*a* rotating in the head pressing direction and the pressing portion 224*a* of the first head frame 22*a* pushing the thermal head 5 connected to the second head frame 22*b*.

Herein, the pressing portion 224*a* is provided closer to the first center portion 120*a* than the second center portion 120*b* in the shaft direction of the platen shaft 6 as described above (refer to FIG. 18). For this reason, the thermal head 5 is pressed against the first platen roller 104*a* by the pressing portion 224*a* with an area close to the first center portion 120*a* as a pressing center. In addition, since a tip portion of the pressing portion 224*a* is formed in a substantially arc as described above, the pressing portion can evenly press the thermal head 5 regardless of the swing angle of the thermal head 5.

When the cover 3 is closed in a state where the first tape cartridge 100*a* is mounted, the thermal head 5 connected to the second head frame 22*b* is pushed by the pressing portion 224*a* of the first head frame 22*a*. Thus, the second head frame 22*b* follows the first head frame 22*a* and rotates in the head pressing direction.

The movement of each unit of the head pressing mechanism 20A in a case where the cover 3 is closed in a state where the second tape cartridge 100*b* is mounted on the cartridge mounting portion 4 will be described based on FIG. 16.

When the cover 3 is closed in a state where the second tape cartridge 100*b* is mounted, the head pressing rib 26 is positioned at the second engagement position as described above. Thus, the lever side engagement portion 263 engages with the second head pressing lever 25*b*. Consequently, the second head pressing lever 25*b* rotates in the counterclockwise direction of FIG. 16, and the second head pressing spring 23*b* stretches. For this reason, the second head frame 22*b* rotates in the head pressing direction, and the thermal head 5 connected to the connection portion 224*b* of the second head frame 22*b* is pressed against the second platen roller 104*b*.

Herein, the connection portion 224*b* is provided closer to the second center portion 120*b* than the first center portion 120*a* in the shaft direction of the platen shaft 6 as described above (refer to FIG. 18). For this reason, the thermal head 5 is pressed against the second platen roller 104*b* by the connection portion 224*b* with an area close to the second center portion 120*b* as a pressing center.

When the cover 3 is closed in a state where the second tape cartridge 100*b* is mounted, the first frame portion 221*a* provided between the second frame portion 221*b* and the thermal head 5 is pushed by the second frame portion 221*b*. Thus, the first head frame 22*a* follows the second head frame 22*b* and rotates in the head pressing direction. At this time, the pressing portion 224*a* provided on the first frame portion 221*a* does not come into contact with the reverse side of the thermal head 5.

Herein, the elastically deformed amount of the first head pressing spring 23*a* when the cover 3 is closed in a state where the first tape cartridge 100*a* is mounted and the elastically deformed amount of the second head pressing spring 23*b* when the cover 3 is closed in a state where second tape cartridge 100*b* is mounted are substantially the same but the second head pressing spring 23*b* has a spring constant larger than the first head pressing spring 23*a* as described above. For this reason, when the first tape cartridge 100*a* is mounted, the thermal head 5 is pressed against the first platen roller 104*a* at the first head pressing force, and when the second tape cartridge 100*b* is mounted, the thermal head 5 is pressed against the second platen roller 104*b* at the second head pressing force larger than the first head pressing force.

The spring constant of the first head pressing spring 23*a* and the spring constant of the second head pressing spring 23*b* may be the same. In this case, the elastically deformed amount of the second head pressing spring 23*b* when the cover 3 is closed in a state where second tape cartridge 100*b* is mounted may be larger than the elastically deformed amount of the first head pressing spring 23*a* when the cover 3 is closed in a state where the first tape cartridge 100*a* is mounted. Consequently, when the first tape cartridge 100*a* is mounted, the thermal head 5 is pressed against the first platen roller 104*a* at the first head pressing force, and when the second tape cartridge 100*b* is mounted, the thermal head 5 is pressed against the second platen roller 104*b* at the second head pressing force larger than the first head pressing force.

As described above, the head pressing mechanism 20A of the modification example includes the first head mechanism 40*a* and the second head mechanism 40*b*. The first head mechanism 40*a* has the pressing portion 224*a*. The first head mechanism 40*a* presses the thermal head 5 against the first platen roller 104*a* by means of the pressing portion 224*a* when the first tape cartridge 100*a* is mounted on the cartridge mounting portion 4. The second head mechanism 40*b* has the connection portion 224*b*, which is connected to the thermal head 5 and is provided at a position different from the position of the pressing portion 224*a* in the shaft direction of the platen shaft 6. The second head mechanism 40*b* presses the thermal head 5 against the second platen roller 104*b* by means of the connection portion 224*b* when the second tape cartridge 100*b* is mounted on the cartridge mounting portion 4.

According to this configuration, in a case where the first tape cartridge 100*a* is mounted, the thermal head 5 is pressed against the first platen roller 104*a* with the pressing portion 224*a* as the pressing center. In a case where the second tape cartridge 100*b* is mounted, the thermal head 5 is pressed against the second platen roller 104*b* with the connection portion 224*b* provided at a position different from the position of the pressing portion 224*a* in the shaft direction of the platen shaft 6 as the pressing center. Therefore, the pressing center for pressing the thermal head 5 against the first platen roller 104*a* and the pressing center for pressing the thermal head 5 against the second platen roller 104*b* can be appropriately switched.

Herein, in the head pressing mechanism 20A, the pressing portion 224*a* is provided closer to the first center portion 120*a* than the second center portion 120*b* in the shaft direction of the platen shaft 6. The connection portion 224*b* is provided closer to the second center portion 120*b* than the first center portion 120*a* in the shaft direction of the platen shaft 6.

According to this configuration, in a case where the first platen roller 104*a* is mounted, the thermal head 5 is pressed against the first platen roller 104*a* by the pressing portion 224*a* with an area close to the first center portion 120*a* as the pressing center. Consequently, concentration of pressing force applied to the thermal head 5 against the first platen roller 104*a* in the shaft direction of the platen shaft 6 is suppressed. In a case where the second platen roller 104*b* is mounted, the thermal head 5 is pressed against the second platen roller 104*b* by the connection portion 224*b* with an area close to the second center portion 120*b* as the pressing center. Consequently, concentration of pressing force applied to the thermal head 5 against the second platen roller 104*b* in the shaft direction of the platen shaft 6 is suppressed.

The first head pressing spring 23*a* is an example of a "first elastic body" of the invention. The second head pressing spring 23*b* is an example of a "second elastic body" of the invention. The first head pressing lever 25*a* is an example of a "first elastic side member" of the invention. The second head pressing lever 25*b* is an example of a "second elastic side member" of the invention.

This application claims priority under 35 U.S.C. § 119 to Japanese Patent Application No. 2017-079625, filed Apr. 13 2017, and No. 2017-250961, filed Dec. 27 2017. The entire disclosure of Japanese Patent Application No. 2017-079625 and No. 2017-250961 are hereby incorporated herein by reference.

What is claimed is:

1. A head pressing mechanism provided in a tape printing apparatus including a cartridge mounting portion, in which a first tape cartridge that accommodates first tape having a first tape width and a first platen roller having a first roller length and a second tape cartridge that accommodates second tape having a second tape width larger than the first tape width and a second platen roller having a second roller length larger than the first roller length are mounted, and a thermal head that performs printing onto the first tape and the second tape, wherein, when the first tape cartridge is mounted, a first head pressing force is applied to the thermal head to press the thermal head against the first platen roller; and when the second tape cartridge is mounted, a second head pressing force is applied to the thermal head to press the thermal head against the second platen roller, wherein the second head pressing force is larger than the first head pressing force.

2. The head pressing mechanism according to claim 1, comprising:

an elastic body that applies force to the thermal head such that the thermal head is pressed against the first platen roller or the second platen roller, wherein an elastically deformed amount of the elastic body is a first deformed amount when the first tape cartridge is mounted, and the elastically deformed amount of the elastic body is a second deformed amount larger than the first deformed amount when the second tape cartridge is mounted.

3. The head pressing mechanism according to claim 2, further comprising:

an elastic side member to which one end of the elastic body is attached, and which is positioned at a first elastic position where the elastic body is elastically deformed such that the elastically deformed amount of the elastic body is the first deformed amount when the first tape cartridge is mounted, and is positioned at a second elastic position where the elastic body is elastically deformed such that the elastically deformed amount of the elastic body is the second deformed amount when the second tape cartridge is mounted.

4. The head pressing mechanism according to claim 3, further comprising:

a cover side member that is provided in a cover opening/closing the cartridge mounting portion, engages with the elastic side member so as to be positioned at a first engagement position where the elastic side member is positioned at the first elastic position if the cover is closed when the first tape cartridge is mounted, and engages with the elastic side member so as to be positioned at a second engagement position where the elastic side member is positioned at the second elastic position if the cover is closed when the second tape cartridge is mounted.

5. The head pressing mechanism according to claim 4, wherein the cover side member is positioned at the first engagement position by not engaging with the first tape cartridge if the cover is closed when the first tape cartridge is mounted, and the cover side member is positioned at the second engagement position by engaging with the second tape cartridge if the cover is closed when the second tape cartridge is mounted.

6. The head pressing mechanism according to claim 5, wherein the cover side member is provided so as to be rotatable at the first engagement position and the second engagement position, the elastic side member is provided so as to be rotatable at the first elastic position and the second elastic position, the elastic side member rotates from the first elastic position to the second elastic position while shifting an engaging part with the cover side member from a first engaging part to a second engaging part when the cover side member rotates from the first engagement position to the second engagement position, and the elastic side member rotates by a first rotation amount with respect to a unit rotation amount of the cover side member when engaging with the cover side member in a first engaging region including the first engaging part, and rotates by a second rotation amount smaller than the first rotation amount with respect to the unit rotation amount of the cover side member when engaging with the cover side member in a second engaging region including the second engaging part.

7. The head pressing mechanism according to claim 4, wherein the second tape cartridge includes a second cartridge case that accommodates the second platen roller, the second cartridge case has a first wall portion facing the cover when the cover is closed in a state where the second tape cartridge is mounted on the cartridge mounting portion and a second wall portion provided on a peripheral portion of the first wall portion, and the cover side member engages with the second tape cartridge including the peripheral portion of the first wall portion.

8. The head pressing mechanism according to claim 1, further comprising:

a first elastic body that elastically deforms when the first tape cartridge is mounted, and applies force to the thermal head such that the thermal head is pressed against the first platen roller at the first head pressing force; and a second elastic body that elastically deforms when the second tape cartridge is mounted, and applies force to the thermal head such that the thermal head is pressed against the second platen roller at the second head pressing force.

9. The head pressing mechanism according to claim 8, further comprising:

a first elastic side member to which one end of the first elastic body is attached and which elastically deforms the first elastic body when the first tape cartridge is mounted; and a second elastic side member to which one end of the second elastic body is attached and which elastically deforms the second elastic body when the second tape cartridge is mounted.

10. The head pressing mechanism according to claim 9, further comprising:

a cover side member that is provided in a cover opening/closing the cartridge mounting portion, is positioned at a first engagement position where the cover side member engages with the first elastic side member if the cover is closed when the first tape cartridge is mounted, and is positioned at a second engagement position where the cover side member engages with the second elastic side member if the cover is closed when the second tape cartridge is mounted.

11. The head pressing mechanism according to claim 10, wherein the cover side member has a first engagement portion in a shape complementary to a second engagement portion provided in the second tape cartridge, and the first engagement portion engages with the second engagement portion if the cover is closed when the second tape cartridge is mounted.

12. A tape printing apparatus comprising:

a cartridge mounting portion in which a first tape cartridge that accommodates first tape having a first tape width and a first platen roller having a first roller length and a second tape cartridge that accommodates second tape having a second tape width larger than the first tape width and a second platen roller having a second roller length larger than the first roller length are mounted;

a thermal head that performs printing onto the first tape when the first tape cartridge is mounted on the cartridge mounting portion and performs printing onto the second tape when the second tape cartridge is mounted on the cartridge mounting portion; and a head pressing mechanism that applies a first head pressing force to the thermal head to press the thermal head against the first platen roller when the first tape cartridge is mounted on the cartridge mounting portion and applies a second head pressing force to the thermal head to press the thermal head against the second platen roller when the second tape cartridge is mounted on the cartridge mounting portion, wherein the second head pressing force is larger than the first head pressing force.

13. A head pressing mechanism provided in a tape printing apparatus including a cartridge mounting portion, in which a first tape cartridge that accommodates first tape and a first platen roller and a second tape cartridge that accommodates second tape and a second platen roller are mounted, a thermal head that performs printing onto the first tape and the second tape, and a platen shaft into which the first platen roller and the second platen roller are inserted, the mechanism comprising:

a first head mechanism that has a pressing portion and presses the thermal head against the first platen roller by means of the pressing portion when the first tape cartridge is mounted on the cartridge mounting portion; and a second head mechanism that is connected to the thermal head, has a connection portion provided at a position different from a position of the pressing portion in a shaft direction of the platen shaft, and presses the thermal head against the second platen roller by means of the connection portion when the second tape cartridge is mounted on the cartridge mounting portion.

14. The head pressing mechanism according to claim 13, wherein the first head mechanism has a first head frame on which the pressing portion is provided, and presses the thermal head against the first platen roller by means of the pressing portion by the first head frame operating when the first tape cartridge is mounted on the cartridge mounting portion, and the second head mechanism has a second head frame on which the connection portion is provided, and presses the thermal head against the second platen roller by means of the connection portion by the second head frame operating when the second tape cartridge is mounted on the cartridge mounting portion.

15. The head pressing mechanism according to claim 13, wherein in the shaft direction of the platen shaft, a distance between the pressing portion and a first center portion, which is a center portion of the first platen roller in the first tape cartridge mounted on the cartridge mounting portion, is shorter than a distance between the pressing portion and a second center portion, which is a center portion of the second platen roller in the second tape cartridge mounted on the cartridge mounting portion, and in the shaft direction of the platen shaft, a distance between the connection portion and the second center portion is shorter than a distance between the connection portion and the first center portion.

16. The head pressing mechanism according to claim 13, further comprising:

a head contact portion that is positioned closer to an inside of a mounting direction of the first tape cartridge and the second tape cartridge than the connection portion is positioned, and causes the thermal head to take an inclined posture, in which an end portion on the inside of the mounting direction approaches the platen shaft and an end portion on an immediately front side of the mounting direction is separated away from the platen shaft, by coming into contact with the thermal head when the cover opening/closing the cartridge mounting portion is opened.

17. The head pressing mechanism according to claim 16, wherein the pressing portion functions as the head contact portion.

18. A tape printing apparatus comprising:

a cartridge mounting portion in which a first tape cartridge that accommodates first tape and a first platen roller and a second tape cartridge that accommodates second tape and a second platen roller are mounted;

a thermal head that performs printing onto the first tape and the second tape;

a platen shaft into which the first platen roller and the second platen roller are inserted; and a head pressing mechanism including a first head mechanism that has a pressing portion and presses the thermal head against the first platen roller by means of the pressing portion when the first tape cartridge is mounted on the cartridge mounting portion, and a second head mechanism that is connected to the thermal head, has a connection portion provided at a position different from a position of the pressing portion in a shaft direction of the platen shaft, and presses the thermal head against the second platen roller by means of the connection portion when the second tape cartridge is mounted on the cartridge mounting portion.

19. The tape printing apparatus according to claim 12, comprising:

an elastic body that applies force to the thermal head such that the thermal head is pressed against the first platen roller or the second platen roller, wherein an elastically deformed amount of the elastic body is a first deformed amount when the first tape cartridge is mounted, and the elastically deformed amount of the elastic body is a second deformed amount larger than the first deformed amount when the second tape cartridge is mounted; and an elastic side member to which one end of the elastic body is attached, and which is positioned at a first elastic position where the elastic body is elastically deformed such that the elastically deformed amount of the elastic body is the first deformed amount when the first tape cartridge is mounted, and is positioned at a second elastic position where the elastic body is elastically deformed such that the elastically deformed amount of the elastic body is the second deformed amount when the second tape cartridge is mounted.

20. The tape printing apparatus according to claim 12, comprising:

a first elastic body that elastically deforms when the first tape cartridge is mounted, and applies force to the thermal head such that the thermal head is pressed against the first platen roller at the first head pressing force;

a second elastic body that elastically deforms when the second tape cartridge is mounted, and applies force to the thermal head such that the thermal head is pressed against the second platen roller at the second head pressing force;

a first elastic side member to which one end of the first elastic body is attached and which elastically deforms the first elastic body when the first tape cartridge is mounted; and a second elastic side member to which one end of the second elastic body is attached and which elastically deforms the second elastic body when the second tape cartridge is mounted.

* * * * *